US009890591B2

(12) United States Patent
Simanjuntak et al.

(10) Patent No.: US 9,890,591 B2
(45) Date of Patent: Feb. 13, 2018

(54) TOP DRIVE MODULE CONNECTOR AND METHODS

(71) Applicant: Canrig Drilling Technology Ltd., Houston, TX (US)

(72) Inventors: Godwin Simanjuntak, Houston, TX (US); Michael Macklin, Tomball, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 1160 days.

(21) Appl. No.: 13/942,250

(22) Filed: Jul. 15, 2013

(65) Prior Publication Data

US 2015/0014063 A1 Jan. 15, 2015

(51) Int. Cl.
*E21B 3/02* (2006.01)

(52) U.S. Cl.
CPC ..... *E21B 3/02* (2013.01); *Y10T 29/49815* (2015.01); *Y10T 29/49826* (2015.01); *Y10T 29/49959* (2015.01); *Y10T 29/53983* (2015.01)

(58) Field of Classification Search
CPC ..... E21B 3/02; Y10T 29/53983
USPC ..... 166/78.1, 85.1, 85.5, 379
See application file for complete search history.

(56) References Cited

U.S. PATENT DOCUMENTS 2,937,008 A 5/1960 Whittle
4,813,493 A 3/1989 Shaw et al.
4,899,959 A 2/1990 Weiler
5,921,329 A 7/1999 Armstrong
6,561,155 B1 5/2003 Williams
6,705,405 B1 * 3/2004 Pietras ..... E21B 19/16 166/380
6,725,949 B2 4/2004 Seneviratne
7,228,913 B2 6/2007 Folk et al.
7,270,189 B2 9/2007 Brown et al.
7,401,664 B2 * 7/2008 Wells ..... E21B 19/16 166/77.51
7,500,531 B2 3/2009 Williams et al.
7,673,675 B2 3/2010 Carr et al.
(Continued)

OTHER PUBLICATIONS

International Search Report and Written Opinion issued for PCT/US2014/043024 dated Oct. 8, 2014, 15 pgs.
(Continued)

*Primary Examiner* — Robert E Fuller
*Assistant Examiner* — David Carroll
(74) *Attorney, Agent, or Firm* — Haynes and Boone, LLP

(57) ABSTRACT

A top drive includes a plurality of modules. The top drive includes a first fastening member and a second fastening member. The first fastening member and the second fastening member are configured to be removably coupled to connect a first module and a second module. In some embodiments, the top drive includes a third fastening member. The third fastening member is configured to be removably coupled to at least one of the first fastening member and the second fastening member, to connect the first module, the second module, and a third module. A tool for assembling or disassembling a top drive includes a fastening portion including an attachment mechanism configured to releasably couple the tool to a portion of a top drive. The tool includes a first housing including a recess disposed therein. The tool includes a first rod disposed at least partially within the recess.

26 Claims, 18 Drawing Sheets

(56) References Cited

U.S. PATENT DOCUMENTS

| | | | | |
|---|---|---|---|---|
| 7,743,853 | B2 | 6/2010 | Rudshaug et al. | |
| 7,748,473 | B2 | 7/2010 | Wells et al. | |
| 7,828,085 | B2 | 11/2010 | Kuttel et al. | |
| 8,151,909 | B2 | 4/2012 | Kuttel et al. | |
| 2005/0279507 | A1 | 12/2005 | Folk et al. | |
| 2006/0096751 | A1 | 5/2006 | Brown et al. | |
| 2007/0039758 | A1 | 2/2007 | Klipstein | |
| 2007/0140801 | A1* | 6/2007 | Kuttel | E21B 19/16 408/129 |
| 2007/0209878 | A1 | 9/2007 | Czechowski et al. | |
| 2007/0240908 | A1 | 10/2007 | Brown et al. | |
| 2007/0272403 | A1* | 11/2007 | Robichaux | E21B 17/05 166/85.1 |
| 2009/0151934 | A1 | 6/2009 | Heidecke et al. | |
| 2010/0089654 | A1 | 4/2010 | Williams | |
| 2012/0048533 | A1 | 3/2012 | Barker | |
| 2012/0160570 | A1 | 6/2012 | Kuttel et al. | |

OTHER PUBLICATIONS

International Application No. PCT/US2006/062414, Search Report and Written Opinion dated Oct. 15, 2007, 8 pgs.
International Application No. PCT/US2006/062414, International Preliminary Report on Patentability dated Jun. 24, 2008, 6 pgs.

* cited by examiner

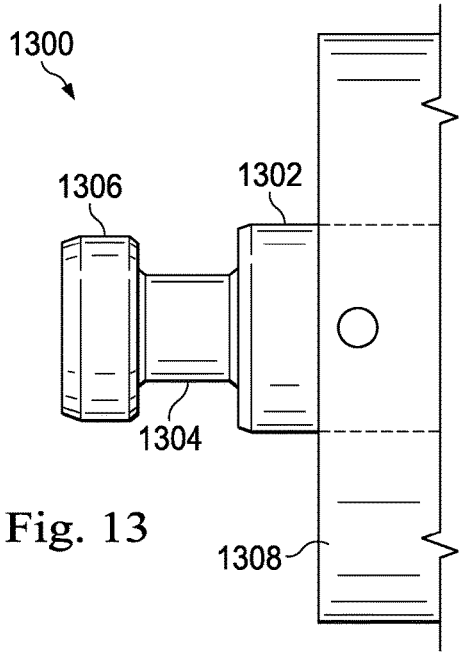
Fig. 13
Fig. 14-1
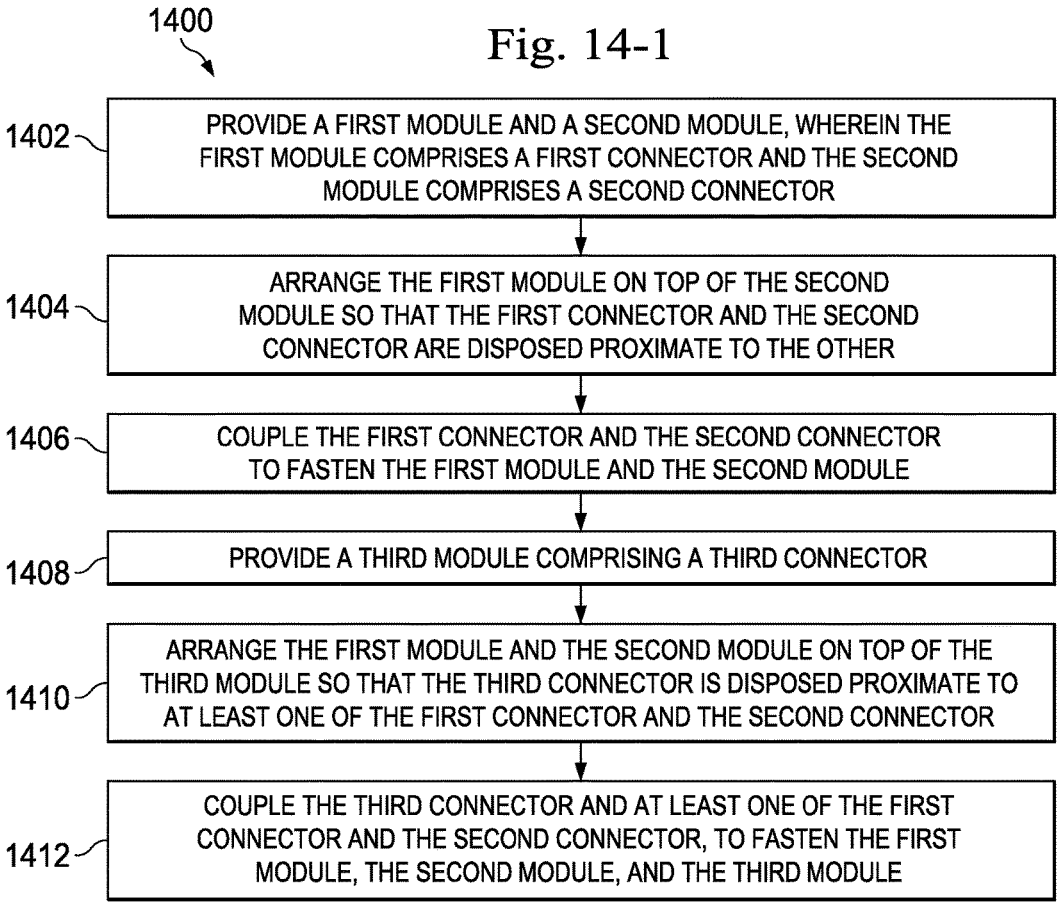

TOP DRIVE MODULE CONNECTOR AND METHODS

FIELD OF THE DISCLOSURE

Generally, the present disclosure relates to a top drive for boring or penetrating the earth during oil and gas well drilling.

BACKGROUND OF THE DISCLOSURE

Top drives are used in oil and gas well drilling. Top drives are drilling tools that hang from a traveling block. Top drives include one or more motors to power a drive shaft to which a drill string is attached. Top drives also incorporate spinning and torque-wrench-like capabilities. In addition, top drives have elevators on links for moving joints of tubular or pipes. Increasingly, top drives have been made more modular. Modular top drives typically include multiple modules. Thus, there has been a need in the art to facilitate improved connections between modular components, and the present disclosure aims to provide such top drive module connectors.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4-1 is a perspective view of three connected modules, according to one or more aspects of the present disclosure.

FIG. 4-2 is a front view of the three connected modules of FIG. 4-1, according to one or more aspects of the present disclosure.

FIG. 4-3 is a side view of the three connected modules of FIG. 4-1, according to one or more aspects of the present disclosure.

FIG. 8-1 is a perspective view of connected and fastened first, second, and third connectors, according to one or more aspects of the present disclosure.

FIG. 8-2 is a cross-sectional view of connected and fastened first, second, and third connectors, according to one or more aspects of the present disclosure.

FIG. 9-1 is a perspective view of a tool, according to one or more aspects of the present disclosure.

FIG. 9-2 is another perspective view of the tool of FIG. 9-1, according to one or more aspects of the present disclosure.

FIG. 11-1 is an exploded partial view of the tool of FIG. 9-1 mounted on a second connector, according to one or more aspects of the present disclosure.

FIG. 11-2 is a cross-sectional view of the tool of FIG. 9-1 tool mounted on a second connector, according to one or more aspects of the present disclosure.

FIG. 12-1 is a perspective view of a fastening pin, according to one or more aspects of the present disclosure.

FIG. 12-2 is a side view of a fastening pin, according to one or more aspects of the present disclosure.

FIG. 12-3 is a side view of fastening pin, rotated about its lateral axis relative to FIG. 12-2, according to one or more aspects of the present disclosure.

FIG. 12-4 is a front view of a fastening pin, according to one or more aspects of the present disclosure.

FIG. 13 is a side view of a rod of the tool of FIG. 9-1, according to one or more aspects of the present disclosure.

FIG. 14-1 is a flow diagram of process for assembling a top drive, according to one or more aspects of the present disclosure.

FIG. 14-2 is a flow diagram of a process for inserting at least one fastening pin, according to one or more aspects of the present disclosure.

DETAILED DESCRIPTION

Figure 1:
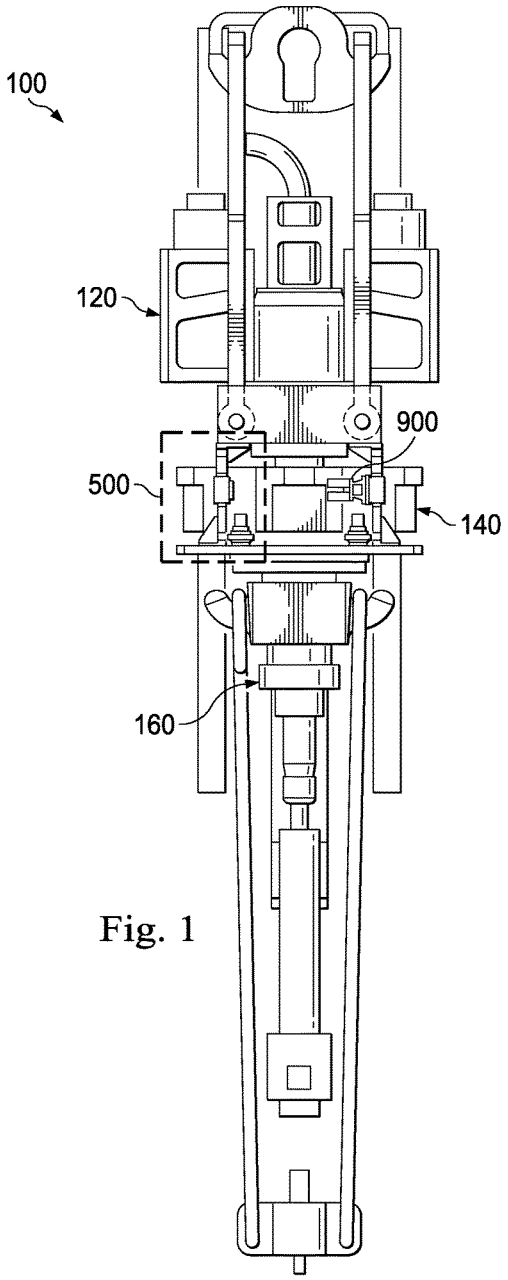
FIG. 1 is a front view of a top drive, according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

According to one or more aspects of the present disclosure, apparatuses and methods for connecting and disconnecting modules of a top drive are shown and described. The apparatuses and/or methods may be implemented in a modular top drive, such as the modular top drives described in U.S. Pat. Nos. 7,828,085 and 8,151,909, which are assigned to Canrig Drilling Technology Ltd. and which are each incorporated herein by express reference thereto in their entireties.

A top drive may be modular in that one or more components, e.g., main bearing housing, gear box, and pipe handler, are separate modules attached by connectors, which can be quickly swapped in and out of the critical path for various reasons, including without limitation for repair, alternative drilling capabilities, and the like. According to one or more aspects of the present disclosure, the connectors include a set of first connectors disposed between a main bearing housing and a gear box. The connectors may include a set of second connectors disposed on the gear box. The connectors may include a set of third connectors disposed between the gear box and the pipe handler. Fastening pins may be installed in the connectors to fasten the modules to each other. Although reference is made to a main bearing housing, a gear box, and a pipe handler, it should be understood that the connectors of the present disclosure can be used to connect any two or any three modules together.

According to one or more aspects of the present disclosure, a set of first connectors, disposed between the main bearing housing and the gear box, is attached to the lower end of the main bearing housing. The gear box includes a set of second connectors, each of which has an opening allowing the insertion of the corresponding first connector. An insertion/removal tool may push a fastening pin through each connector to facilitate fastening of the main bearing housing and the gear box. Features of each connector may assist with azimuth and elevation positioning.

According to one or more aspects of the present disclosure, the set of third connectors, disposed between the gear box and the pipe handler, may be attached to a pipe handler. The gear box includes a set of second connectors, each of which has an opening allowing the insertion of the corresponding first and optional third connectors. An insertion/removal tool may be used to facilitate arranging a fastening pin through each connector to fasten, for example, main bearing housing, gear box, and pipe handler. Features of each connector may assist with azimuth and elevation positioning.

According to one or more or more aspects of the present disclosure, the connectors described herein advantageously allow for time savings when removing, installing, or replacing one or more modules of the top drive. When one module of a modular top drive needs to be adjusted/repaired/replaced (e.g., to quickly change gear ratios or replace damaged components), the one module, as opposed to the entire top drive, may be changed out. The connectors between modules described herein provide a quick connect/disconnect arrangement, allowing for more efficient change out of modules. The connectors described herein may also advantageously decrease risk of injury by allowing for fewer human operators in close proximity to the top drive and nearby equipment during module change out.

Referring to FIG. 1, a front view of a top drive is shown, according to one or more aspects of the present disclosure. Top drive 100 may be described as modular in that it includes a plurality of modules. Top drive 100 may be described as an assembly (i.e., of one or more modules). Top drive 100, for example, includes first module 120, second module 140, and third module 160. Top drive 100 may include more or fewer modules, and/or other structures, in various embodiments. In FIG. 1, modules 120, 140, and 160 are connected. First module 120 may be described as a first module or upper module. According to an exemplary embodiment, first module 120 is a main bearing housing module or core module. Second module 140 may be described as a second module or middle module. According to an exemplary embodiment, second module 140 is a gear box module. Third module 160 may be described as a third module or lower module. According to an exemplary embodiment, third module 160 is a pipe handler module. While "first," "second," and "third," and "upper," "middle," and "lower" have been used to describe modules in FIG. 1, in various embodiments, the relative orientation and positioning of the individual modules may be different. Any one or all of modules 120, 140, 160 may function other than as a main bearing housing module, gear box module, and pipe handler module.

Figure 5:
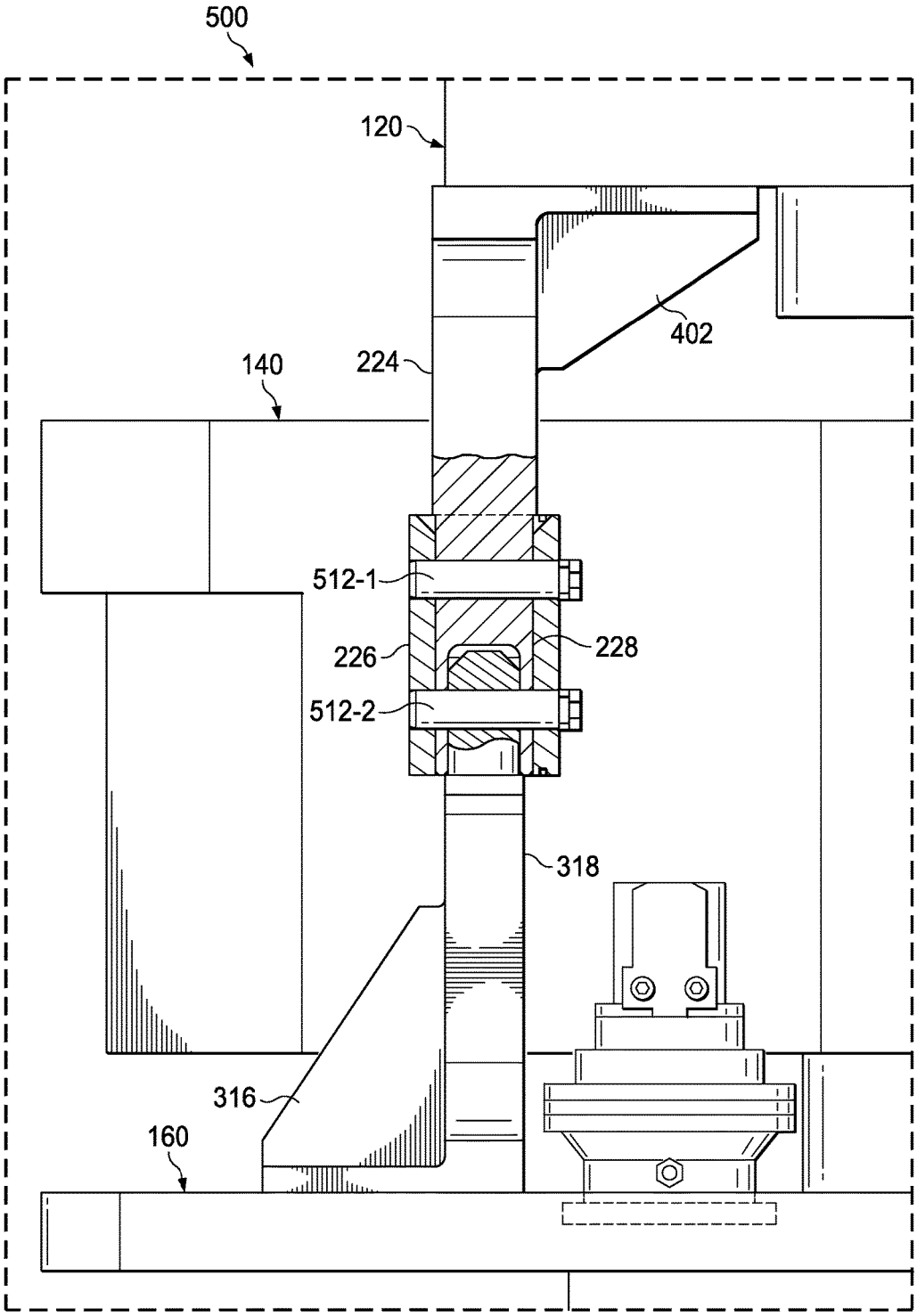
FIG. 5 is a zone identified in FIG. 1 shown in greater detail, according to one or more aspects of the present disclosure.

Modules 120, 140, 160 may be connected by one or more connectors as described herein. As shown, zone 500 identifies a location of the top drive where modules 120, 140, 160 are connected. A closer view of zone 500 is shown in FIG. 5 and described in more detail in the discussion thereof. According to one or more aspects of the present disclosure, modules 120, 140, 160 may be connected in multiple locations. For example, modules 120, 140, 160 may include four sets of connectors and be connected at four locations on top drive 100. The discussion herein generally describes the features of one set of connectors; it is to be understood that the discussion applies to similar features of the other sets of connectors. In various embodiments, modules 120, 140, 160 may be connected more or fewer times and at different locations. FIG. 1 shows tool 900, which is described in more detail herein.

Figure 2:
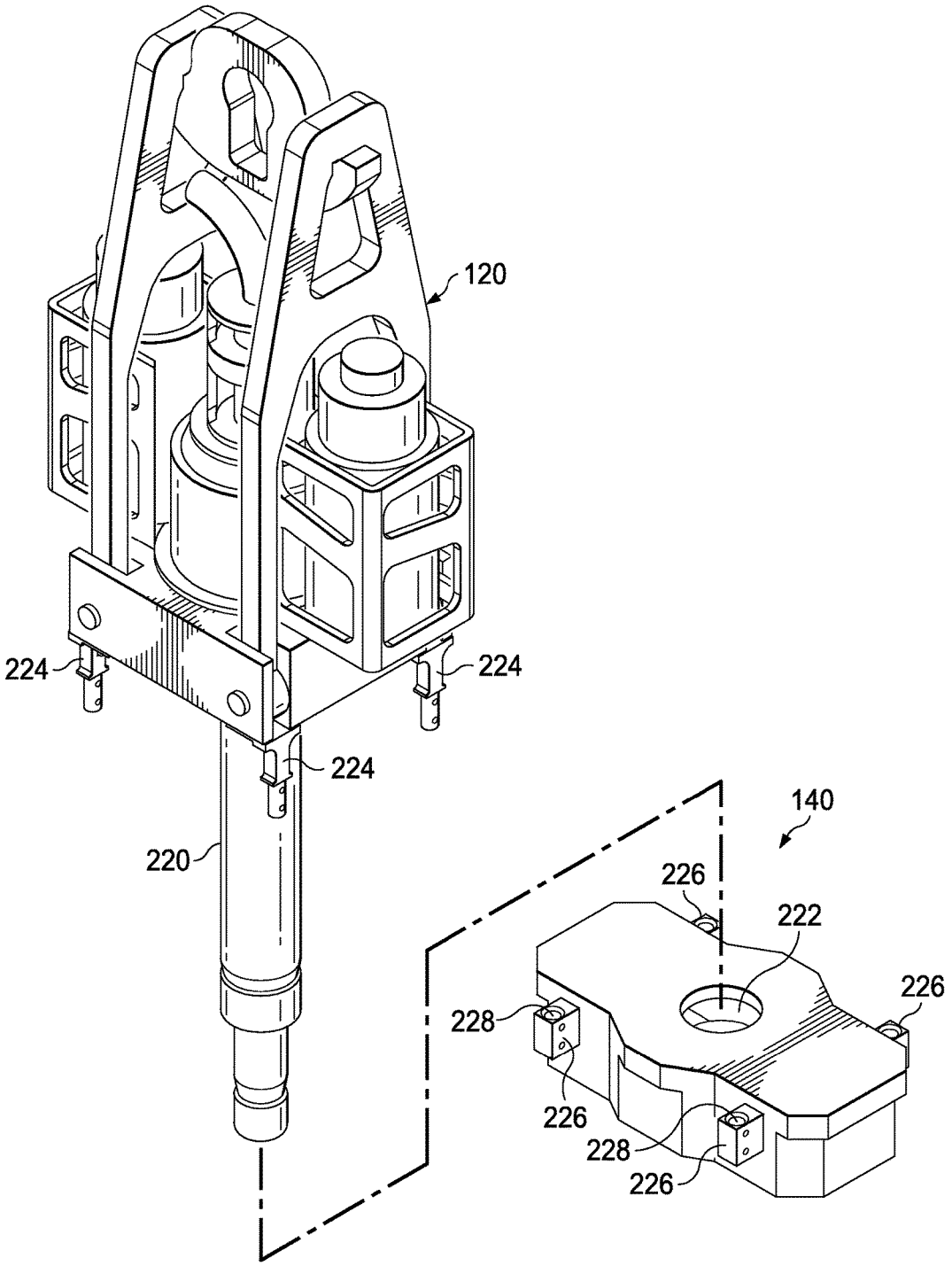
FIG. 2 is a perspective view of two modules, according to one or more aspects of the present disclosure.

Referring to FIG. 2, a perspective view of two modules is shown, according to one or more aspects of the present disclosure. First module 120 and second module 140 are shown before modules 120, 140 are connected. First module 120 includes a plurality of first connectors 224. Each of the first connectors 224 may be described as a first fastening member. First module 120 may include, for example, four first connectors 224 (one is not shown in FIG. 2). The first connectors 224 may be distributed around first module 120. Proximal ends of first connectors 224 may extend from first module 120. For example, first connectors 224 may be integrally formed with, bolted on, welded on, or otherwise coupled to first module 120.

Second module 140 includes a plurality of second connectors 226. Each of the second connectors 226 may be described as a second fastening member. Second module 140 may include, for example, four second connectors 226. Second connectors 226 may be distributed around second module 140. Second connectors 226 may extend from second module 140. For example, second connectors 226 may be integrally formed with, bolted on, welded on, or otherwise coupled to second module 140. According to an exemplary embodiment, first connector 224 and second connector 226 are configured to be removably coupled to connect the first module 120 and second module 140 to each other. In some embodiments, first connector 224 and second connector 226 are components that are placed adjacent to each other when first module 120 and second module 140 are connected. In some embodiments, second connector 226 may include a cavity 228 extending longitudinally therein. Cavity 228 is sized and shaped to receive at least a portion of the first connector 224 and at least a portion of the third connector 318 (FIG. 3) when modules 120, 140, 160 are connected. In some embodiments, cavity 228 is a through hole and extends through the entire longitudinal direction from top to bottom of each second connector 226. In other embodiments, a cavity sufficient to receive at least a portion of first connector 224 and at least a portion of third connector 318 exists at the top and bottom of each second connector 226 even when the cavity is not connected therethrough. Thus, as shown, the plurality of second connectors 228 are arranged and adapted to opposingly connect to the plurality of first connectors 224.

To join first module 120 and second module 140, first module 120 and/or second module 140 may be moved closer together such that extension member 220 passes through opening 222. According to an exemplary embodiment, the first module 120 is lowered onto second module 140. In other embodiments, the modules may be moved closer together via different methods. At least a portion of each first connector 224 also fits into cavity 228 of each opposed second connector 226.

Figure 3:
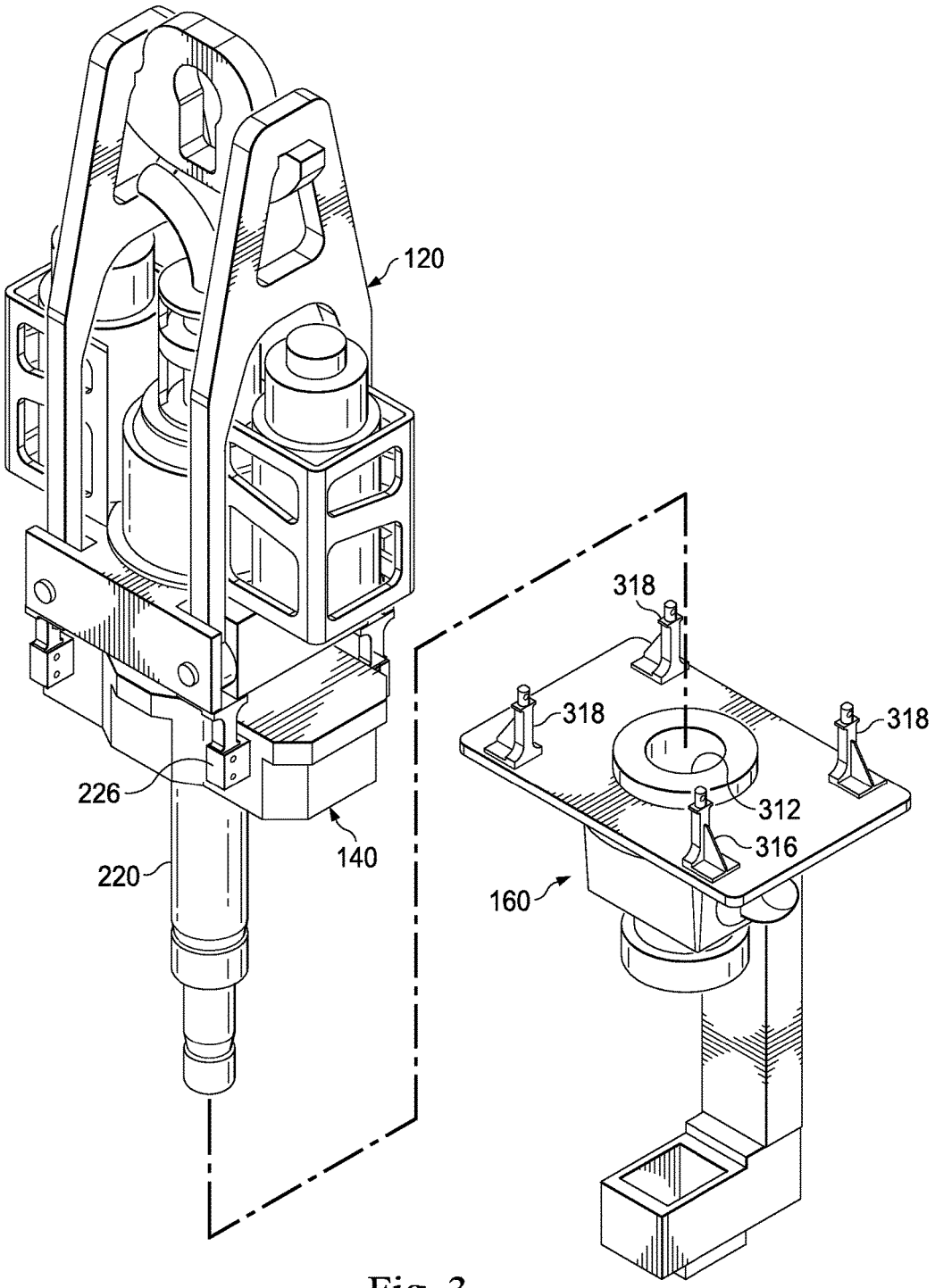
FIG. 3 is a perspective view of three modules, according to one or more aspects of the present disclosure.

Referring to FIG. 3, a perspective view of three modules is shown, according to one or more aspects of the present disclosure. First module 120 and second module 140 are shown after they have been connected to each other, and third module 160 is shown before it has been connected to the others. Third module 160 includes a plurality of third connectors 318. Each of the third connectors 318 may be described as a third fastening member. Third module 160 may include, for example, four third connectors 318. Third connectors 318 may be distributed around third module 160. Proximal ends of third connectors 318 may extend from third module 160. For example, third connectors 318 may be integrally formed with, bolted on, welded on, or otherwise coupled to third module 160. According to an exemplary embodiment, third connector 318 is configured to be removably coupled to at least one of the coupled first connector 224 and the second connector 226, to connect the first module 120, second module 140, and third module 160 to each other. Third module 160 may include support members 316, which help to anchor and/or stabilize third connectors 318.

To join third module 160 with first module 120 and second module 140, third module 160 and first module 120/second module 140 may be moved closer together such that extension member 220 passes through opening 312. According to an exemplary embodiment, the combined first module 120/second module 140 is lowered onto third module 160 (or third module 160 is raised towards the combined modules). In other embodiments, the modules may be moved closer together via different methods, such as both being moved towards each other into engagement. In some embodiments, third connector 318 is placed adjacent to at least one of first connector 224 and second connector 226 when first module 120, second module 140, and third module 160 are combined. In the depicted embodiment, at least a portion of third connector 318 also fits into cavity 228 of second connector 226 when the cavity 228 extends through the entire longitudinal direction from top to bottom of each second connector 226 (or when a sufficient cavity exists at the top and bottom of each second connector 226 even when the cavity is not connected therethrough).

Figures 1, 4:
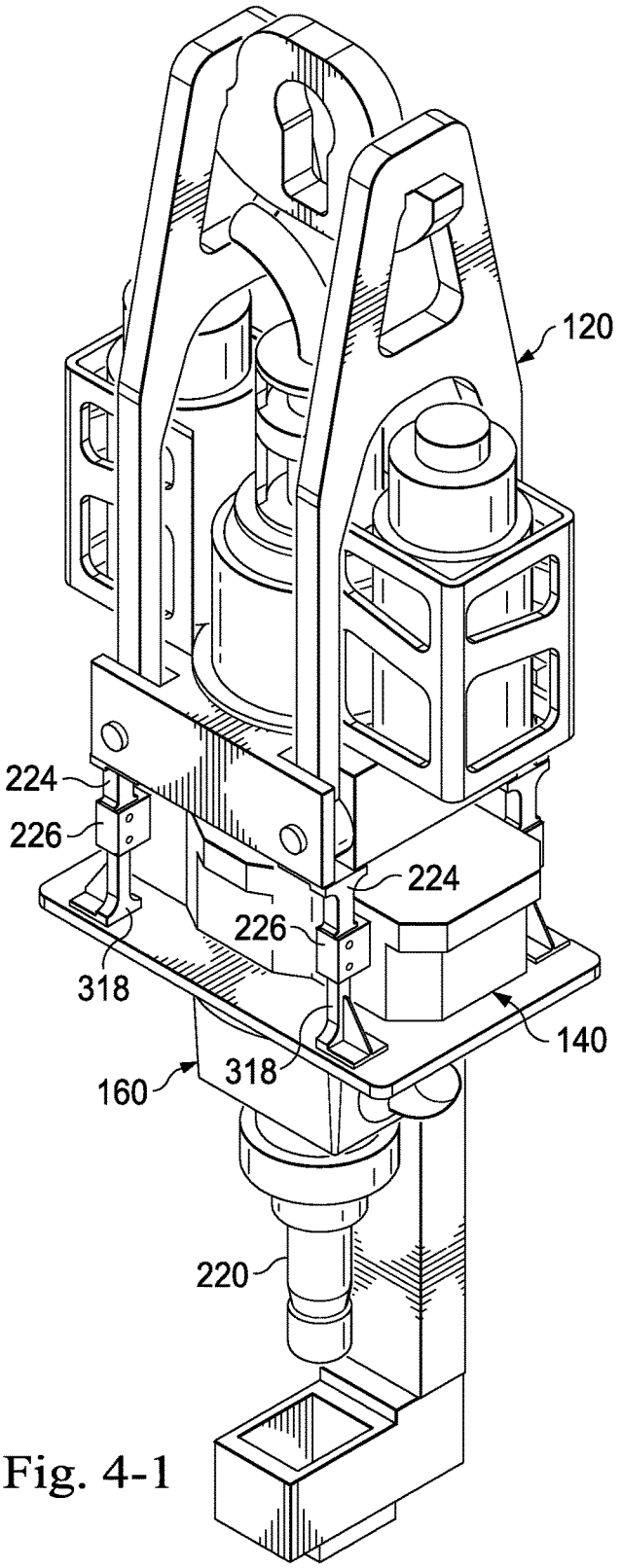
Figures 2, 4:
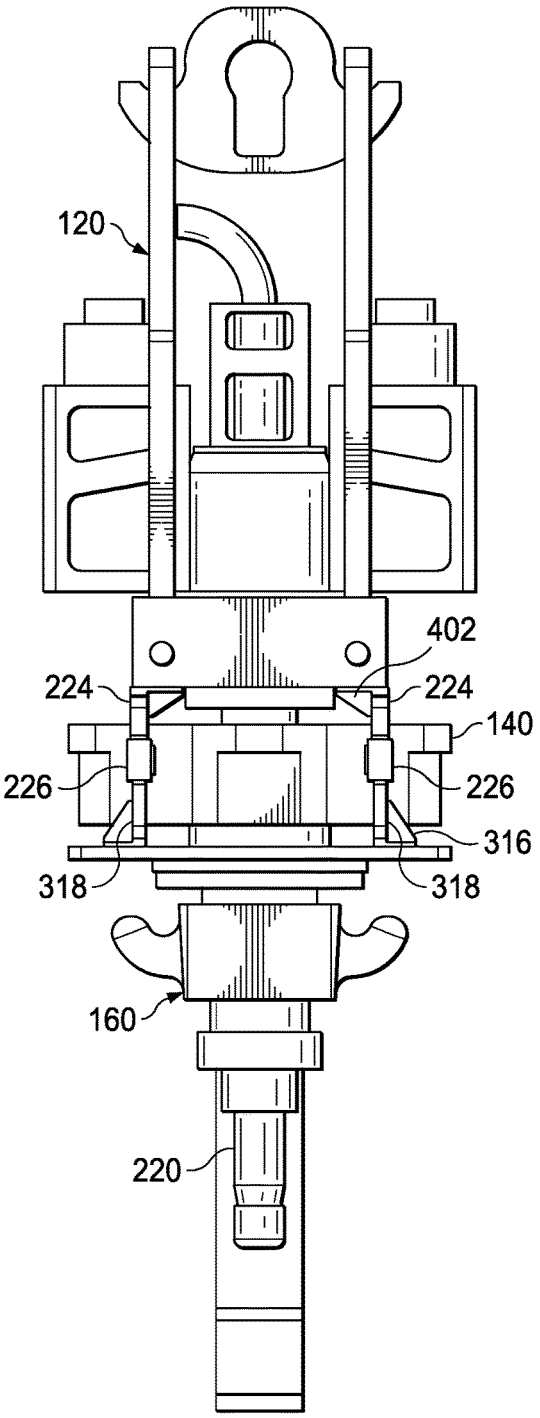
Figures 3, 4:
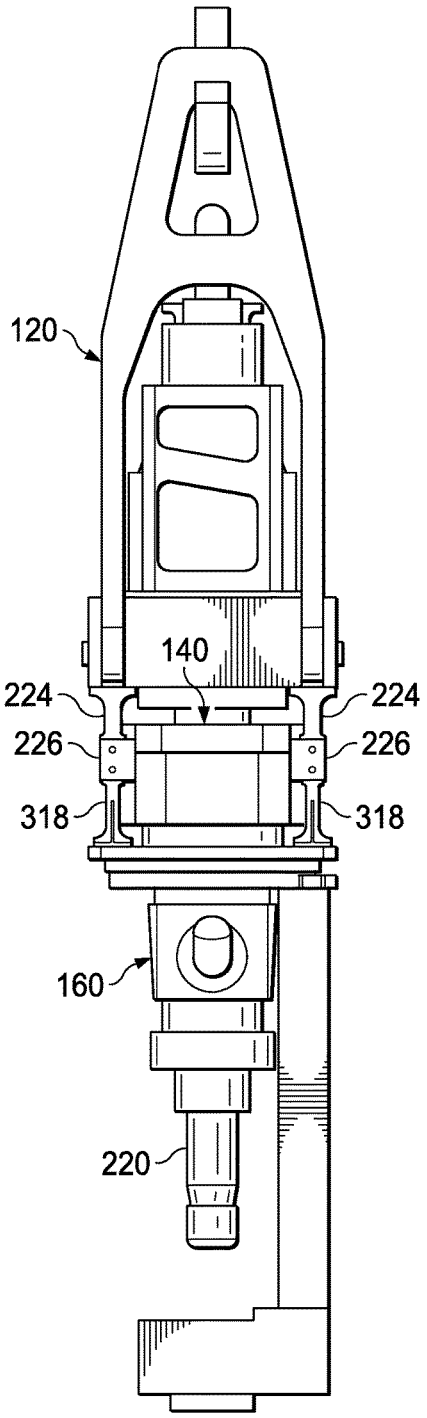

The discussion below generally refers to FIGS. 4-1, 4-2, 4-3. FIG. 4-1 shows a perspective view of three connected modules, according to one or more aspects of the present disclosure. FIG. 4-2 shows a front view of the three connected modules of FIG. 4-1, according to one or more aspects of the present disclosure. FIG. 4-3 shows a side view of the three connected modules of FIG. 4-1, according to one or more aspects of the present disclosure. Modules 120, 140, 160 may be connected via first connectors 224, second connectors 226, and third connectors 318. When connected, at least a portion of first connector 224 and third connector 318 are each received in a cavity 228 of second connector 226. FIGS. 4-1, 4-2, 4-3 show modules 120, 140, 160 that are connected at multiple locations of the assembly. In various embodiments, more, fewer, and/or different structures may be added to the assembly shown in FIGS. 4-1, 4-2, and 4-3 to form top drive 100.

Referring to FIG. 5, a zone identified in FIG. 1 is shown in greater detail, according to one or more aspects of the present disclosure. Zone 500 is close-up of view of one of the locations of top drive 100 where modules 120, 140, and 160 are connected. A proximal end of first connector 224 may extend from first module 120. A proximal end of third connector 318 may extend from third module 160. Distal ends of first connector 224 and third connector 318 may each be received in a cavity 228 of a corresponding second connector 226. Modules 120, 140, 160 may be fastened via fastening pins 512-1 and 512-2, which are inserted through first connector 224, second connector 226, and third connector 318. According to an exemplary embodiment, fastening pin 512-1 may be inserted through first connector 224 and second connector 226 when first module 120 and second module 140 are connected. Fastening pin 512-2 may be inserted through first connector 224, second connector 226, and third connector 318 when third module 160 is connected with combined first module 120/second module 140. Support member 316 may anchor and/or stabilize third connector 318. Similarly, support member 402 may anchor and/or stabilize first connector 224.

Figure 6:
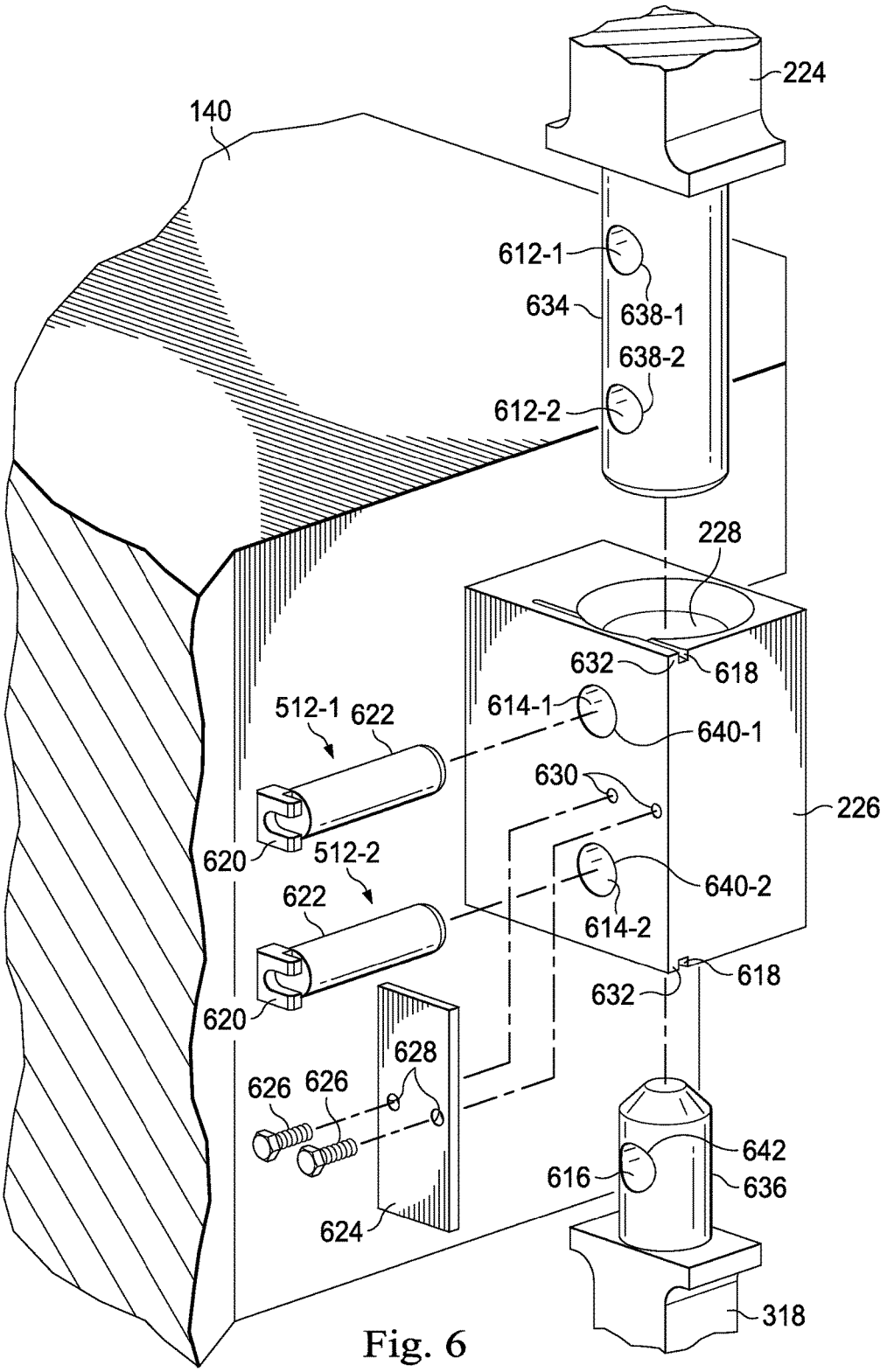
FIG. 6 is an exploded view of first, second, and third connectors, according to one or more aspects of the present disclosure.
Figure 7:
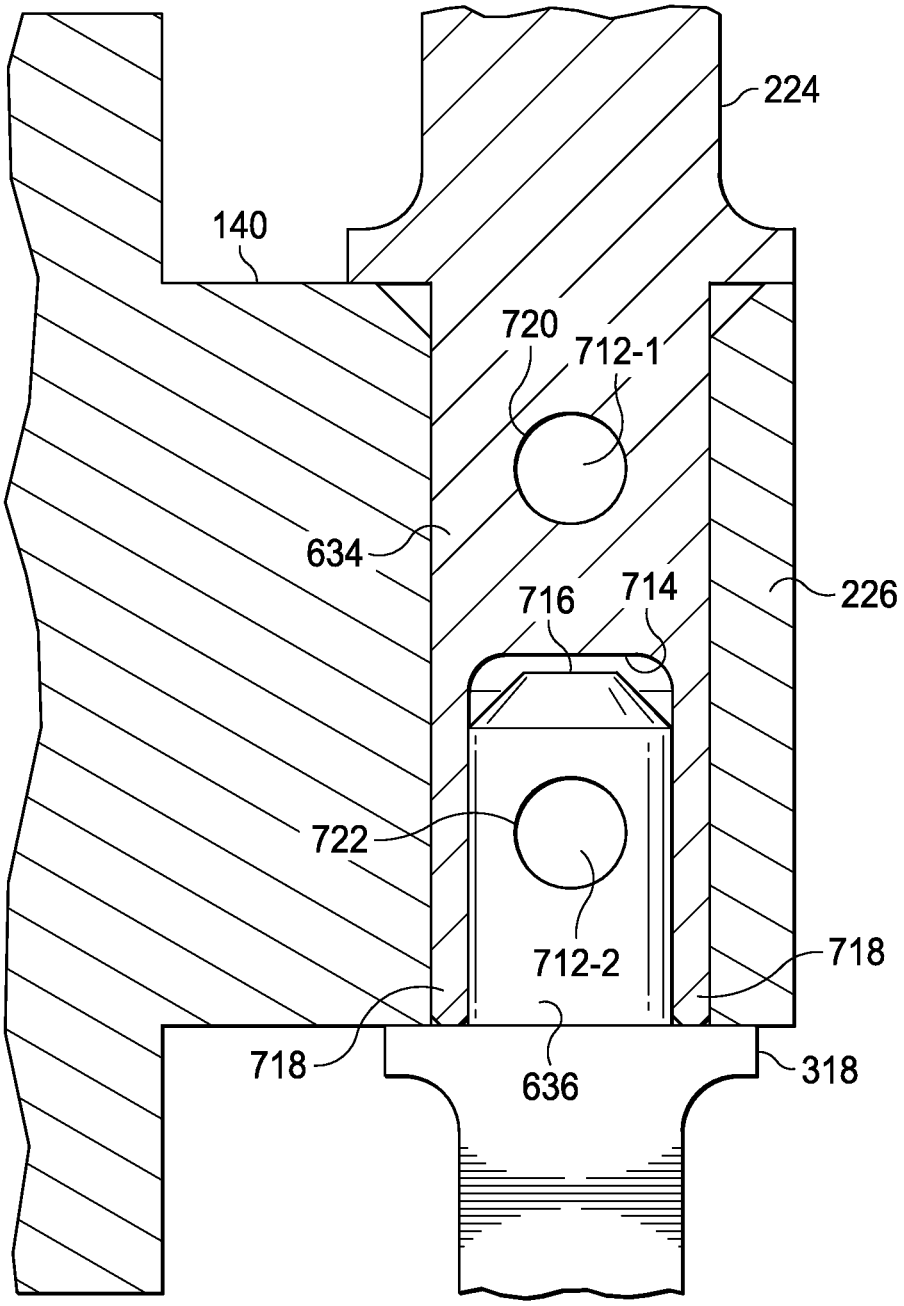
FIG. 7 is a cross-sectional view of connected first, second, third connectors, according to one or more aspects of the present disclosure.
Figures 1, 8:
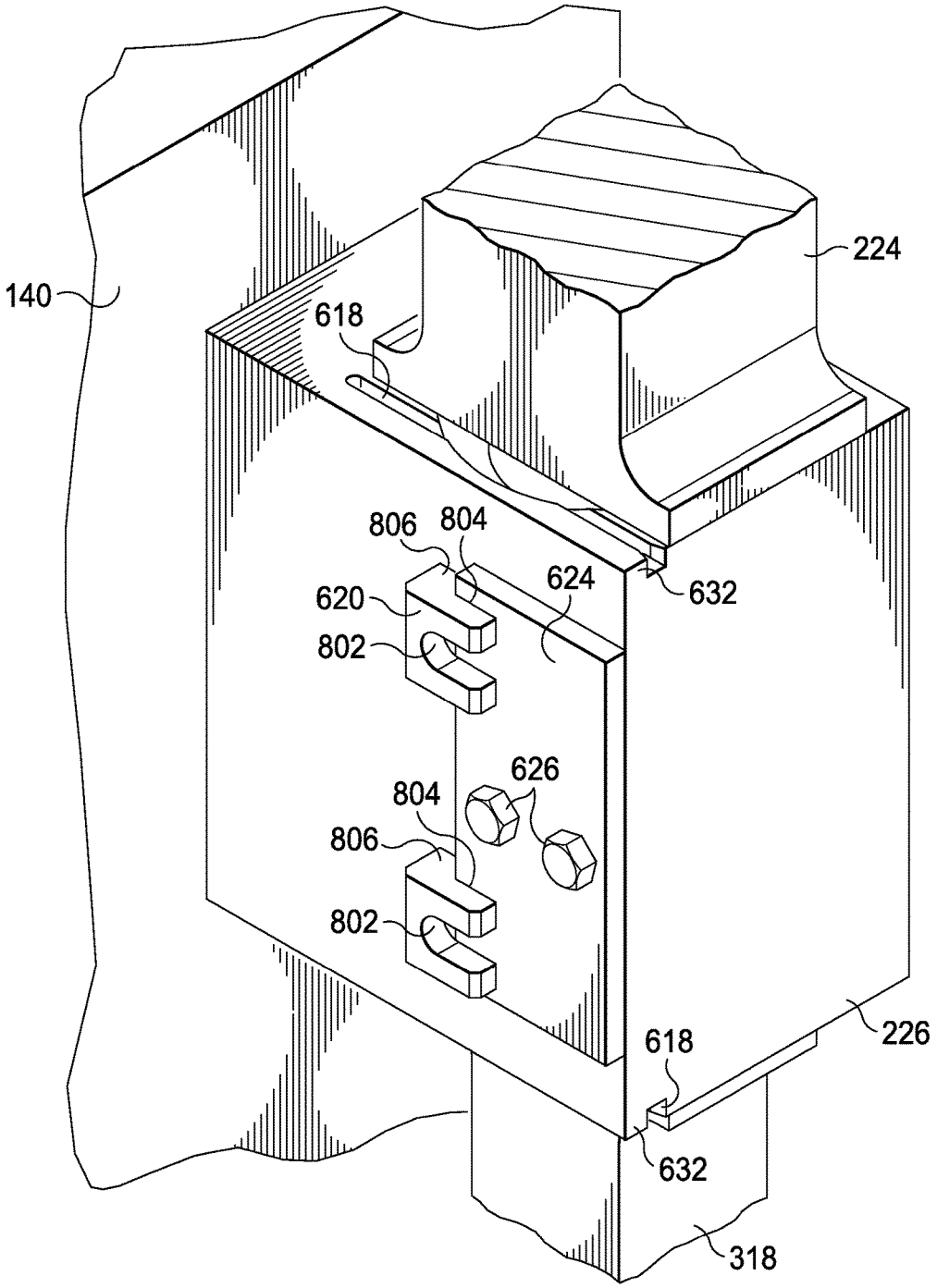
Figures 2, 8:
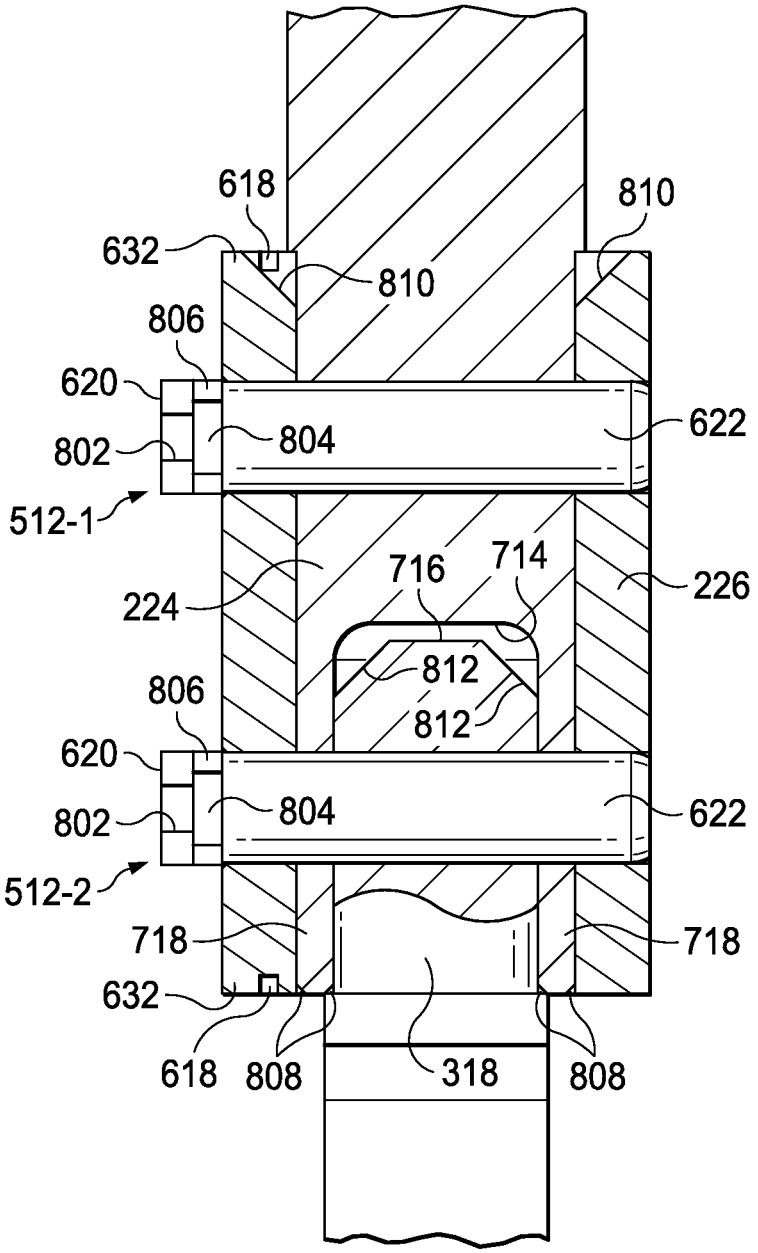

The discussion below generally refers to FIGS. 6, 7, 8-1, 8-2. FIG. 6 is an exploded view of first, second, and third connectors, according to one or more aspects of the present disclosure. FIG. 7 is a cross-sectional view of connected first, second, third connectors, according to one or more aspects of the present disclosure. FIG. 8-1 is a perspective view of connected and fastened first, second, and third connectors, according to one or more aspects of the present disclosure. FIG. 8-2 is a cross-sectional view of connected and fastened first, second, and third connectors, according to one or more aspects of the present disclosure.

Referring now to FIG. 6, first connector 224 includes a distal end 634. Distal end 634 may be received in cavity 228 of second connector 226 when the first module 120 and second module 140 are connected. Distal end 634 may include bore 612-1 and bore 612-2, which extend laterally therein. Bores 612-1, 612-2 may define a lateral extent inside distal end 634 between apertures on opposite sides of distal end 634. Two apertures 638-1, 638-2 on one side of distal end 634 are shown in FIG. 6. Fastening pins 512-1, 512-2 may be inserted through bores 612-1, 612-2.

Second connector 226 includes a cavity 228 extending longitudinally therethrough. When first module 120 and second module 140 are combined, cavity 228 may receive distal end 634 of first connector 224. When third module 160 is combined with the modules 120, 140, cavity 228 may additionally receive distal end 636 of third connector 318. Second connector 226 may include bore 614-1 and bore 614-2, which extend laterally therein. Bores 614-1, 614-2 may define a lateral extent inside second connector 226 between apertures on opposite sides of distal end 634. Two apertures 640-1, 640-2 on one side of second connector 226 are shown in FIG. 6. Fastening pins 512-1, 512-2 may be inserted through bores 614-1, 614-2.

Third connector 318 includes distal end 636. Distal end 636 may be received in cavity 228 of second connector 226 when third module 160 is connected to first module 120 and second module 140. Distal end 636 may include bore 616, which extends laterally therein. Bore 616 may define a lateral extent inside distal end 636 between apertures on opposite sides of distal end 636. One aperture 642 on one side of distal end 636 is shown in FIG. 6. Fastening pin 512-2 may be inserted through bore 616.

According to one or more aspects of the present disclosure, when first module 120 and second module 140 are connected, bore 612-1 and bore 614-1 align such that they define substantially coextensive spaces. Similarly, aperture 638-1 and aperture 640-1 align such that the borders of the apertures define at least substantially the same shape. This arrangement is shown, for example, in FIG. 7 as bore 712-1, which is an aligned bore including bores 612-1, 614-1. Aperture 720 is an aligned aperture including apertures 638-1, 640-1. Bores 612-1, 614-1 and apertures 638-1, 640-1 align because at least a portion of first connector 224 (e.g., distal tip 634) is received in cavity 228 when first module 120 and second module 140 are connected. (Bores 612-2, 614-2, as well as apertures 638-2, 640-2 also align when first module 120 and second module 140 are connected. Their alignment is discussed below.) Fastening pin 512-1 may be inserted through bore 712-1 to fasten first module 120 and second module 140 to each other. This is shown, for example, in FIG. 8-2. Fastening pin 512-1 may be inserted through first connector 224 and second connector 226 to releasably connect the two modules.

According to one or more aspects of the present disclosure, when third module 160 is connected to first module 120 and second module 140, bore 612-2, bore 614-2, and bore 616 of third module 160 align such that they define substantially coextensive spaces. Similarly, aperture 638-2, aperture 614-2, and aperture 642 align such that the borders of the apertures define at least substantially the same shape. This is shown, for example, in FIG. 7, where bore 712-2 is an aligned bore including bores 612-2, 614-2, 616. Aperture 722 is the aligned aperture including apertures 638-2, 640-2, 642. Fastening pin 512-2 may be inserted through bore 712-2 to releasably fasten modules 120, 140, 160 to each other. This is shown, for example, in FIG. 8-2. Fastening pin 512-2 may be inserted through first connector 224, second connector 226, and third connector 318.

According to one or more aspects of the present disclosure, distal end 634 of first connector 224 includes a hollow portion or opening 714. This is shown, for example, in FIG. 7 where distal end 634 includes tip 718. Third connector 318 includes distal end 636 and tip 716. When modules 120, 140, and 160 are connected, distal end 636 of third connector 318 is received in the hollow portion 714 of the first connector 224. Bores 612-2, 614-2, 616 and apertures 638-2, 640-2, 642 align because at least a portion of third connector 318 (e.g., distal tip 636) is received in cavity 228 and because distal end 636 is received in the hollow portion 714 when first module, second module 140, and third module 160 are connected.

Fastening modules 120, 140, 160 as shown in FIG. 8-2 may reduce tolerance stack ups. Because pin 512-2 is inserted through connectors 224, 226, 318, the shear load transferred directly from first connector 224 to third connector 318 (as opposed to the shear load being transferred from first connector 224, to second connector 226, and finally to third connector 318). (The shear load is also transferred from the first connector 224 to the second connector 226 via the insertion of pin 512-2 through connectors 224, 226.) In other embodiments, an unreduced amount of tolerance stack ups may be used when fastening modules 120, 140, 160.

Referring back to FIG. 6, second connector 226 may include grooves 618 to receive corresponding lips 908, 912 of tool 900 (FIGS. 9-1, 9-2, 10). Second connector 226 may also include lips 632, which are received in corresponding grooves 910, 914 (FIGS. 9-1, 9-2, 10). In other embodiments, more or fewer lips/grooves and lips/grooves in different locations may be provided. As described in greater detail herein, tool 900 may be releasably mounted on second connector 226. According to an exemplary embodiment, during assembly and disassembly of top drive 100, tool 900 is used for inserting and removing fastening pins 512-1, 512-2. During operation of top drive 100, tool 900 may be removed and plate 624 substituted. Second connector 224 may include holes 630 for fasteners 626. Fasteners 626 may be used to fasten plate 624 between head 620 of fastening pins 512-1, 512-2 and second connector 226 when fastening pins 512-1, 512-2 are inserted through the aligned bores to fasten modules 120, 140, 160 to each other. Fasteners 626 may be inserted through holes 628 of plate 624. While plate 624 is described as being bolted on second connector 226, any coupling mechanism may be used to dispose plate 624 between head 620 of fastening pins 512-1, 512-2 and second connector 226. This is shown, for example, in FIG. 8-1. Fastening pins 512-1, 512-2 include head portions 620, body portions 622, and neck portions 806. This is shown, for example, in FIGS. 6, 8-1, and 8-2. FIG. 8-2 omits plate 624 and fasteners 626. Head portions 620 include first concavity or first cutaway portion 802. Adjacent to neck portions 806 and between head portions 620 and body portions 622 are second concavity or second cutaway portion 804. As shown in FIG. 8-1, plate 624 may be received in second concavities 804 when plate 624 is mounted between head 620 of fastening pins 512-1, 512-2 and second connector 226. Plate 624 may advantageously maintain the position and orientation of pins 512-1 and 512-2 during, e.g., operation of the top drive.

As shown in FIG. 8-2, a variety of components in the top drive system may include chamfered, e.g., beveled, edges and/or fillets, which allow for some tolerance when top drive 100 is assembled. According to one or more aspects of the present disclosure, components which are receiving or being received by another component may include chamfered edges. For example, the portion of second connector 226 receiving first connector 224 includes chamfered edges 810. Tips 718 of first connector 224 include chamfered edges 808 as shown. Tip 716 of third connector 318 includes chamfered edges 812.

Figures 1, 9:
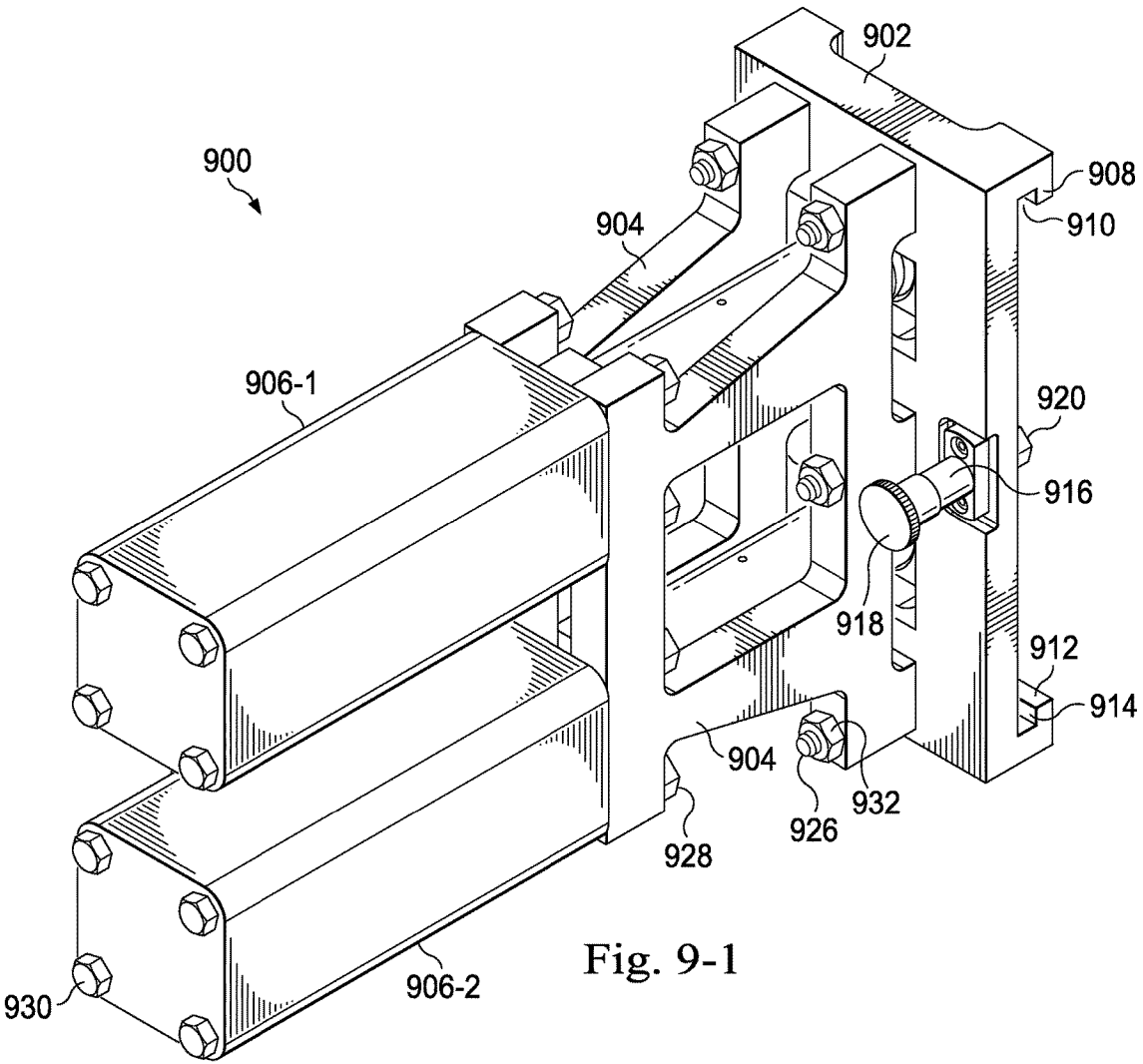
Figures 2, 9:
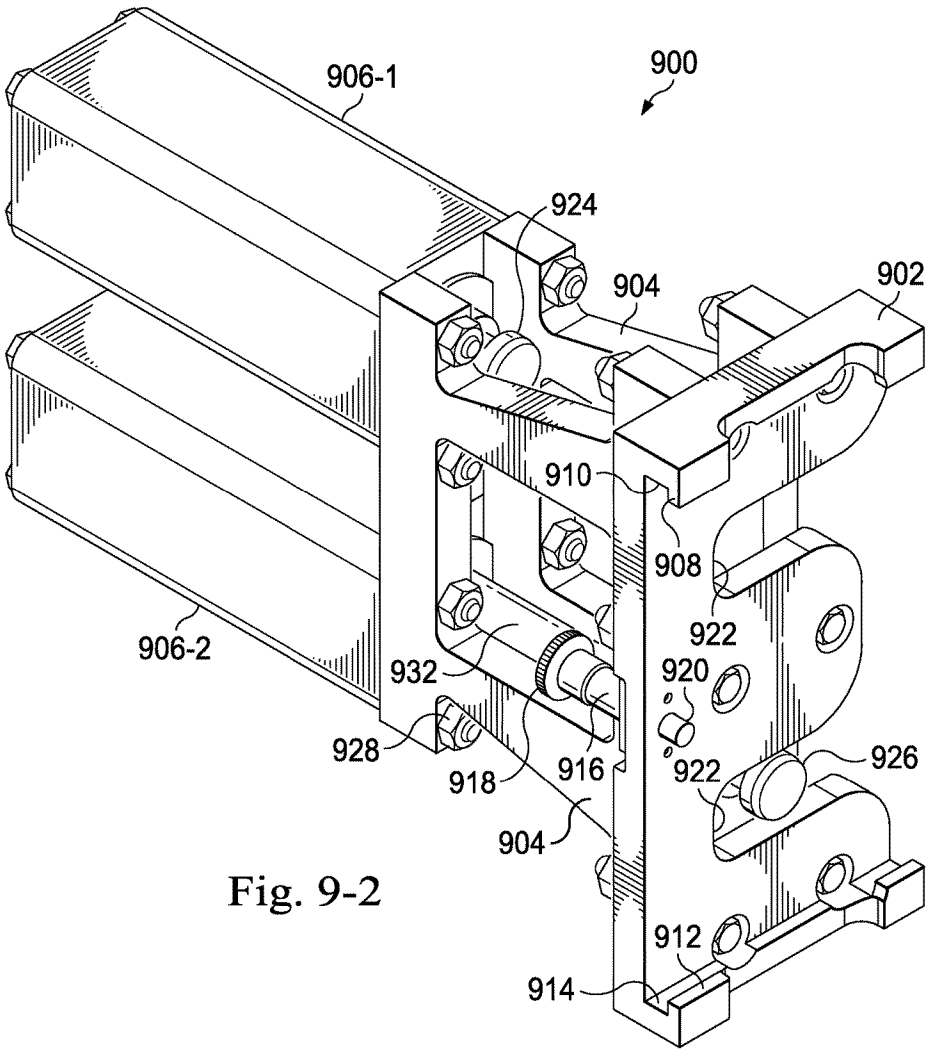
Figure 10:
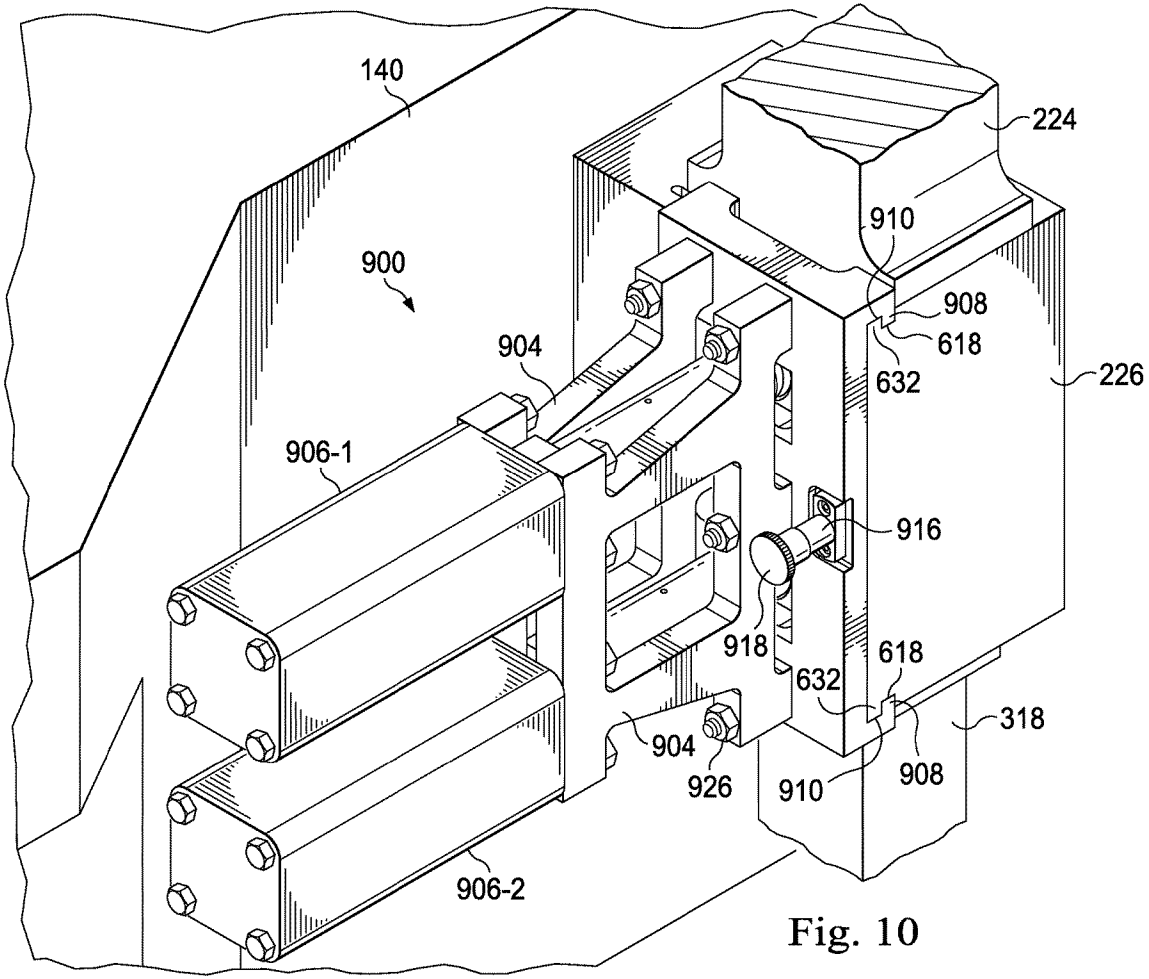
FIG. 10 is a perspective view of the tool of FIG. 9-1 mounted on a second connector, according to one or more aspects of the present disclosure.

The discussion below generally refers to FIGS. 9-1, 9-2, 10. FIG. 9-1 shows a perspective view of a tool, according to one or more aspects of the present disclosure. FIG. 9-2 shows another perspective view of the tool of FIG. 9-1, according to one or more aspects of the present disclosure. FIG. 10 shows a perspective view of the tool of FIG. 9-1 mounted on a second connector, according to one or more aspects of the present disclosure.

Figures 1, 11:
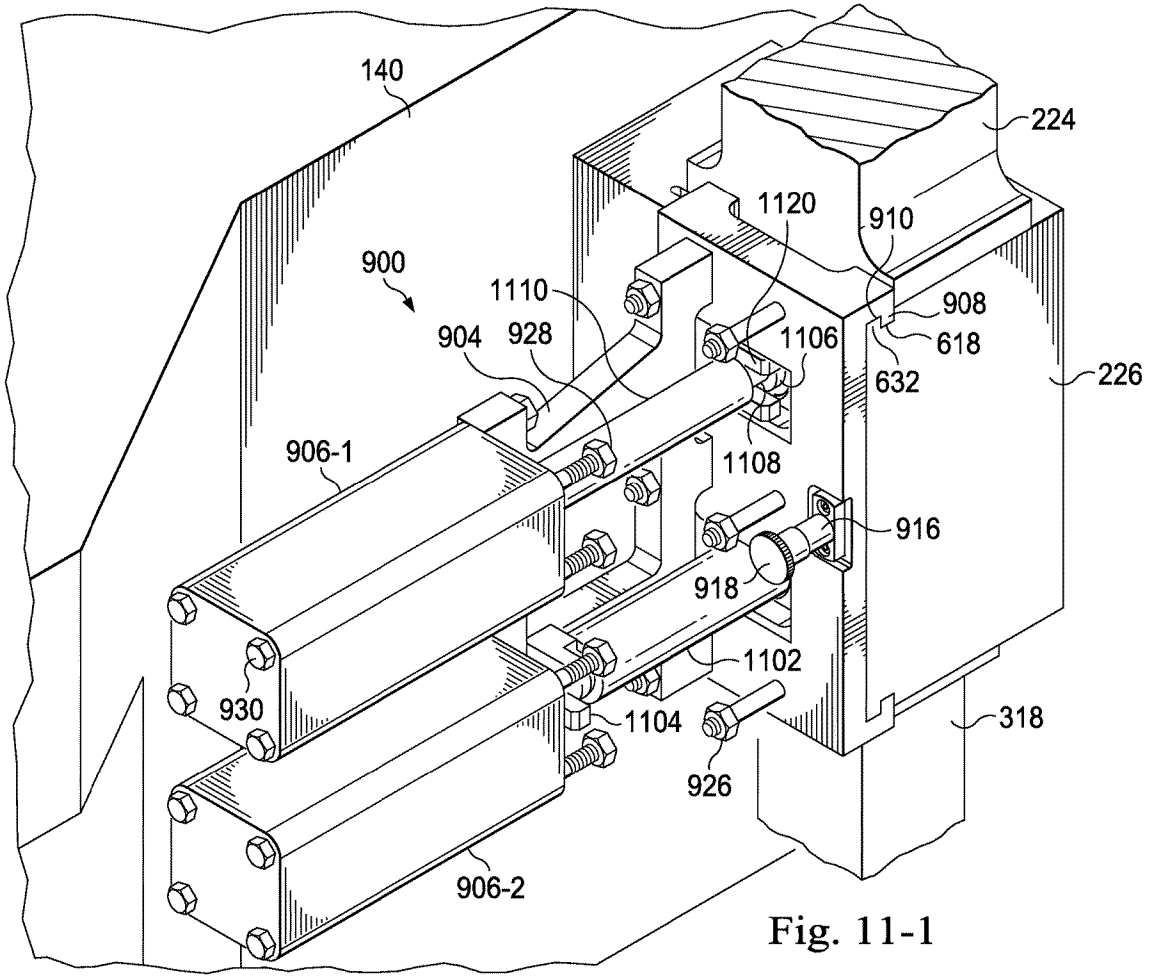
Figures 2, 11:
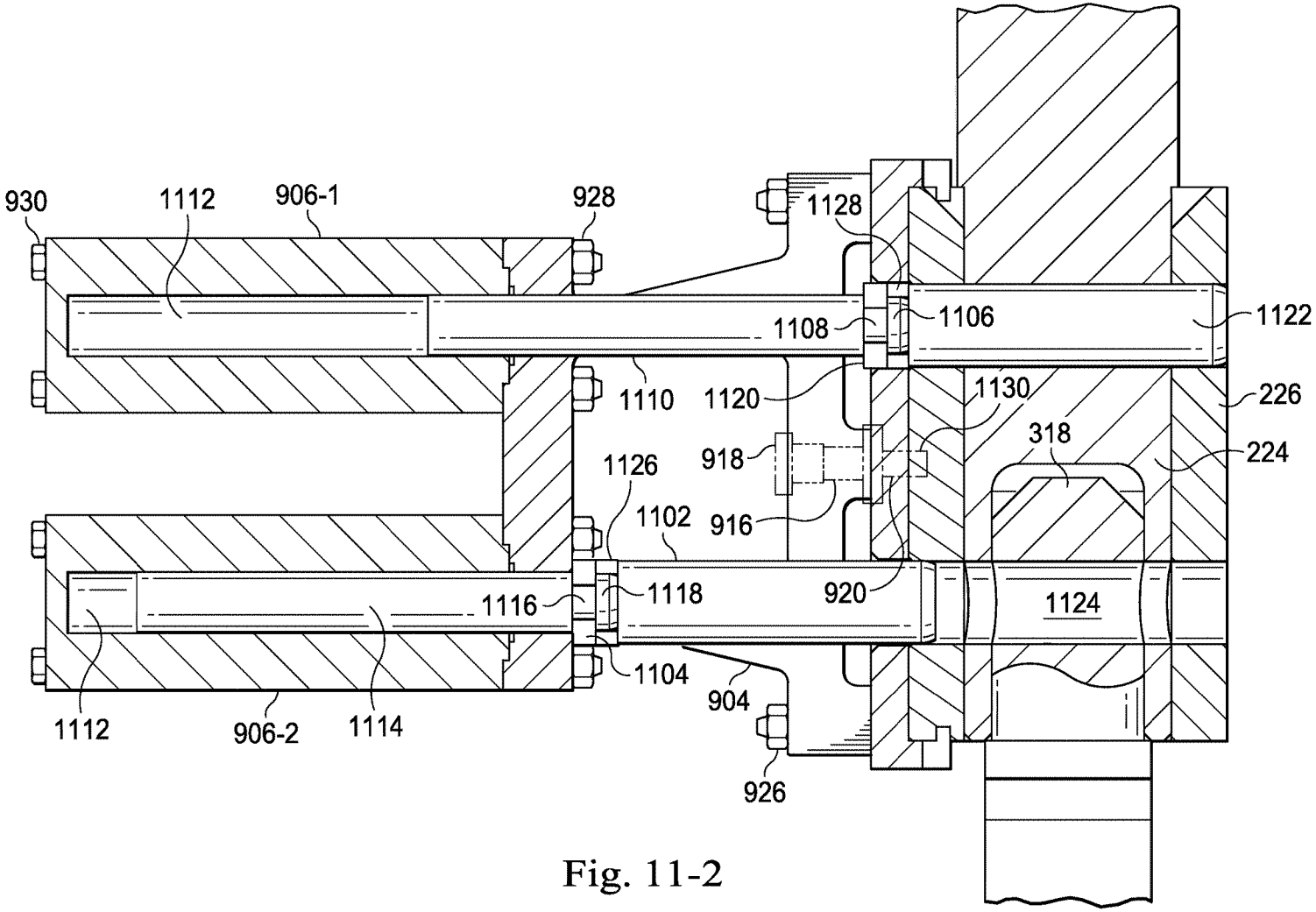

During assembly and/or disassembly of top drive 100 (e.g., the addition or removal of one or more modules), tool 900 may be used to insert and/or remove fastening pins from their corresponding bores. Tool 900 may be referred to variously as an insertion tool and a removal tool in the discussion herein because tool 900 is "double-acting" or dual-purpose in that it allows and provides back and forth lateral movement of rods 1102, 1110 as shown in FIGS. 11-1 and 11-2. As discussed herein, rods 1102, 1110 are coupled to fastening pins. When the rods move laterally back and forth, the rods are inserted and removed from their corresponding aligned bores, respectively. Thus, first module 120, second module 140, and/or third module 160 may be fastened and unfastened using tool 900.

Tool 900 includes fastening portion 902, supporting portion 904, and housings 906-1, 906-2. Tool 900 may be slidably mounted on (i.e., may slide laterally onto and off of) second connector 226, although any suitable mounting/fastening device or technique may be used if desired. A distal part of the fastening portion 902 may include an attachment mechanism configured to releasably couple the tool to a portion of a top drive (e.g., second connector 226). In some embodiments, the distal part of fastening portion 902 includes lips 908, 912, which may be received in corresponding grooves 618 (shown in FIGS. 8-1 and 8-2) of second connector 226 (i.e., a top drive portion). Lips 632 of second connector 226 may be received in corresponding grooves 910, 914 of tool 900. When tool 900 is slidably mounted on and removed from second connector 226, lips 908, 912 may slide along grooves 618, and grooves 910, 914 may slide along lips 632.

Fastening portion 904 includes recesses 922 as shown in FIG. 9-2 to allow fastening pins coupled to rods of tool 900 (FIGS. 11-1, 11-2) to pass therethrough, into and out of second connector 226. Fastening portion 902 includes alignment member 920. Alignment member 920 may be received in a corresponding alignment recess 1130 of second connector 226 when tool 900 axially aligns with second connector 226, as tool 900 is slidably mounted on second connector 226. According to an exemplary embodiment, alignment recess 1130 is a threaded hole (e.g., hole 630) for fastener 626. Alignment recess 1130 is shown in FIG. 11-2. FIG. 11-2 shows tool 900 mounted on second connector 226, and thus, alignment member 920 is received in alignment recess 1130. When tool 900 is axially aligned with second connector 226, rods 1102, 1110 of tool 900 (and fastening pins 1102, 1122 coupled thereto) are axially aligned with the corresponding aligned bores. When tool 900 is slidably mounted on second connector 226, an operator may stop moving tool 900 once alignment member 920 is received in alignment recess 1130. A head portion 918 may include a spring mechanism. According to an exemplary embodiment, head portion 918 is integrally formed or otherwise coupled to alignment member 920 such that when head portion 918 is pulled back and/or released, alignment member 920 is also pulled back and/or released. Mounting feature 916 may be coupled to fastening portion 904 and may include a recess through which alignment member 920 moves. When tool 900 is to be removed from second connector 226, head portion 918 may be pulled back such that alignment member 920 is removed from alignment recess 1130. An operator may then slide tool 900 off of second connector 226.

A proximal part of fastening portion 902 is coupled to supporting portion or supporting member 904. Supporting portion 904 may include a plurality of cross-members that couple housings 906-1, 906-2 to fastening portion 902. Thus, housings 906-1, 906-2 may be coupled to the proximal part of fastening portion 902 via supporting portion 904. A variety of mechanisms may be used to couple supporting portion 904 to housings 906-1, 906-2 and to fastening portion 902. In FIGS. 9-1, 9-2, 10, bolt 930 and nut 928 (and others like them) are shown coupling housings 906-1, 906-2 to supporting portion 904. Bolt 926 and nut 932 (and others like them) are shown coupling fastening portion 902 to supporting portion 904. In other embodiments, these components may be welded together, integrally formed, or otherwise coupled.

Figures 1, 12:
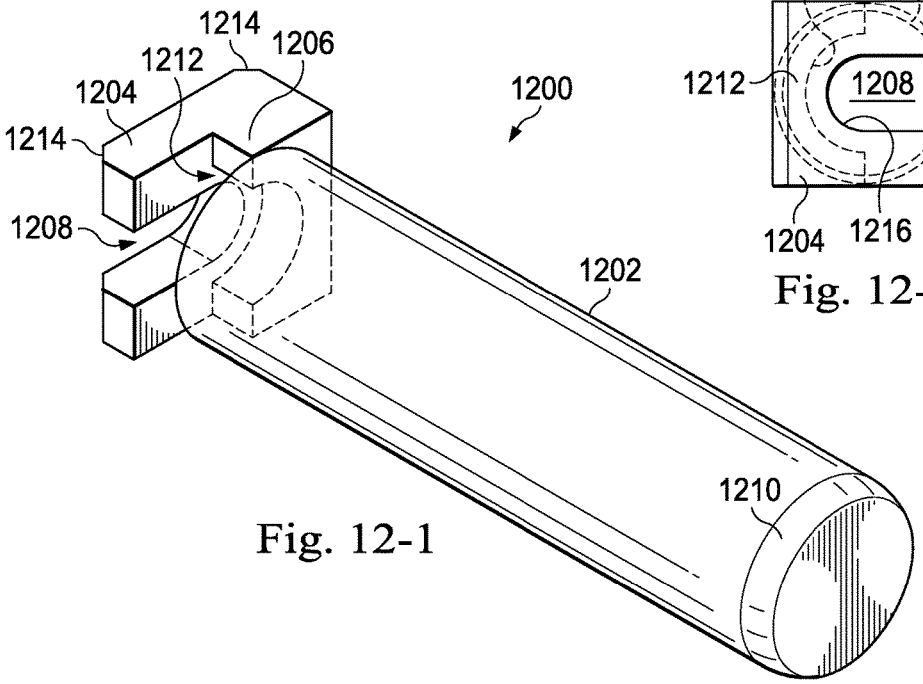
Figures 4, 12:
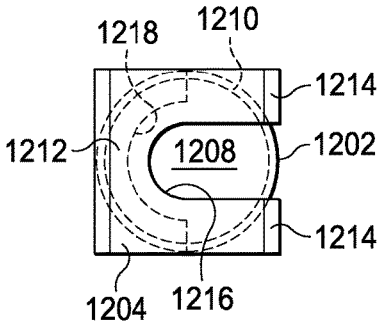
Figures 2, 12:
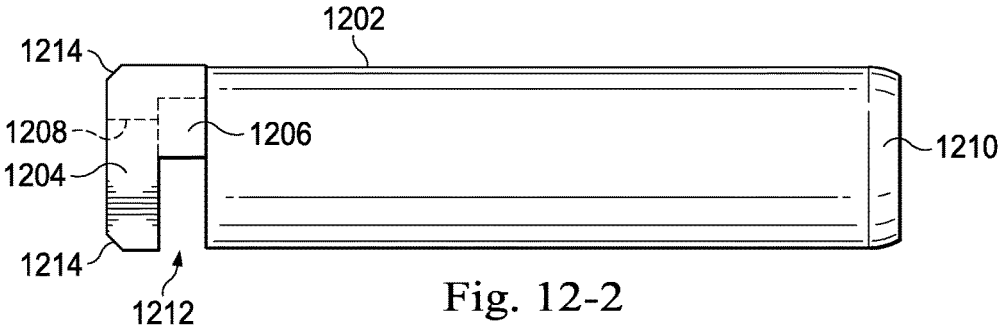
Figures 3, 12:
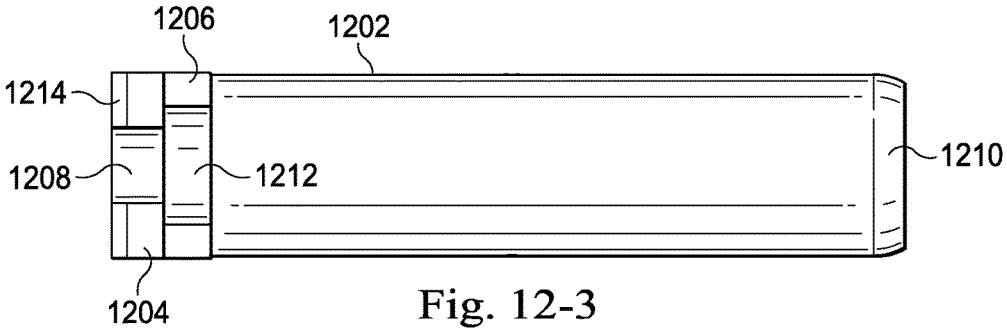

The discussion below generally refers to FIGS. 11-1, 11-2, 12-1, 12-2, 12-3, 12-4, and 13. FIG. 11-1 is a partial view of the tool of FIG. 9-1 mounted on a second connector, according to one or more aspects of the present disclosure. One supporting member 904 is not shown in FIG. 11-1, compared to FIG. 10. FIG. 11-2 is a cross-sectional view of the tool of FIG. 9-1 mounted on a second connector, according to one or more aspects of the present disclosure. FIG. 12-1 is a perspective view of a fastening pin, according to one or more aspects of the present disclosure. FIG. 12-2 is a side view of a fastening pin, according to one or more aspects of the present disclosure. FIG. 12-3 is a side view of fastening pin, rotated about its longitudinal axis relative to FIG. 12-2, according to one or more aspects of the present disclosure. FIG. 12-4 is a front view of a fastening pin, according to one or more aspects of the present disclosure. FIG. 13 is a side view of a rod of the tool of FIG. 9-1, according to one or more aspects of the present disclosure.

Tool 900 includes housings 906-1, 906-2. Housings 906-1, 906-2 may house rods 1110, 1102, respectively, in interior portions thereof, such as when they are disengaged from the connectors. Rods 1110, 1114 are movable into and out of housings 906-1, 906-2. Rods 1110, 1114 are disposed along longitudinal axes of housings 906-1, 906-2, respectively. Housings 906-1, 906-2 include cavities 1112 into which and out of which rods 1110, 1114 move. According to an exemplary embodiment, housings 906-1, 906-2 are fluidly coupled to a hydraulic line, and rods 1110, 1114 are hydraulically actuated between a first position (e.g., retracted position) substantially inside of housing 906-1, 906-2 and a second position (e.g., advanced position) substantially outside of housing 906-1, 906-2. According to an exemplary embodiment, housings 906-1, 906-2 are hydraulic cylinders. While a hydraulic mechanism is specifically mentioned, any mechanism (e.g., electric) for moving rods 1110, 1114 may be used. The engagement of tool 900 and second connector 226 via lips 908, 912, 632 and grooves 618, 910, 914 advantageously resists any forces acting on tool 900 when rods 1110, 1114 are actuated. This may be assisted by the extension of alignment member 920 into alignment recess 1130 to prevent lateral sliding of the tool 900 relative to the second connector 226. Thus, tool 900 maintains engagement with second connector 226 during movement of rods 1110, 1114.

End portions of rods 1110, 1114 may be removably coupled to fastening pins 1122, 1102, respectively. As shown in FIG. 13, an end portion of rod 1300 includes a head portion 1306, a neck portion 1304, and a body portion 1302. A radius of neck portion 1304 may be smaller than a radius of head portion 1306. The end portion is shown projecting out of housing 1308. As shown in FIGS. 12-1, 12-2, 12-3, 12-4, fastening pin 1200 includes a head portion 1204, neck portion 1206, and body portion 1202. Head portion 1204 includes a first concavity or first cutaway portion 1208. Fastening pin 1200 also includes a second concavity or cutaway portion 1212, adjacent to neck portion 1206 and between head portion 1204 and body portion 1202. Head portion 1204 includes chamfered edges 1214 and body portion 1202 includes tapered end 1210. According to an exemplary embodiment, when rod 1300 and fastening pin 1200 are coupled, head portion 1306 of rod 1300 is received in second concavity 1212 of fastening pin 1200. Neck portion 1304 of rod 1300 is received in first concavity 1208 of fastening pin 1200.

FIGS. 11-1, 11-2 show fastening pin 1122 is coupled to rod 1110. Head portion 1106 of rod 1110 is received in the second cavity of fastening pin 1122 adjacent to neck portion 1128 of fastening pin 1122. Neck portion 1108 of rod 1110 is received in the first concavity of head portion 1120 of fastening pin 1122. Similarly, FIGS. 11-1, 11-2 show fastening pin 1102 is coupled to rod 1114. Head portion 1118 of rod 1114 is received in the second cavity of fastening pin 1102 adjacent to neck portion 1126 of fastening pin 1102. Neck portion 1116 of rod 1114 is received in the first concavity of head portion 1104 of fastening pin 1102.

FIGS. 11-1, 11-2 may depict a time after first module 120 and second module 140 have been fastened and before third module 160 is fastened to first module 120 and second module 140. Fastening pin 1122 is inserted in the corresponding aligned bores of first connector 224 and second connector 226. The fastening pin is removably insertable into a first top drive module and a second top drive module so as to connect at least a first top drive module and second top drive module to each other when inserted into a connection portion of each of the first and second top drive modules. In some embodiments, the fastening pin is removably insertable into a third top drive module so as to connect at least a first top drive module, second top drive module, and third top drive module when inserted into a connection portion of each of the first, second, and third top drive modules. Tool 900 is mounted on second connector 226. Rod 1110 has been actuated from a first position substantially inside the housing 906-1 to a second position substantially outside of housing 906-1. Because fastening pin 1122 is coupled to rod 1110, fastening pin 1122 has also been moved from a second position where the fastening pin is not inserted in connectors 224, 226 to a first position where the fastening pin is inserted in connectors 224, 226. Fastening pin 1122 is received in aligned bores of first connector 224, second connector 226, and third connector 318.

In FIGS. 11-1, 11-2, third module 160 has been connected to first module 120 and second module 140, but not yet fastened with fastening pin 1102. Rod 1114 is in a first position, substantially inside of housing 906-2. Fastening pin 1102, which is coupled to rod 1114, is in a first position where the fastening pin is not inserted through connectors 224, 226, 318. Once rod 1114 is actuated, fastening pin 1102 will be inserted into aligned bore 1124 of connectors 224, 226, 318. Once fastening pin 1102 is inserted into aligned bore 1124, third module 160 is connected and fastened with first module 120 and second module 140.

Figures 2, 14:
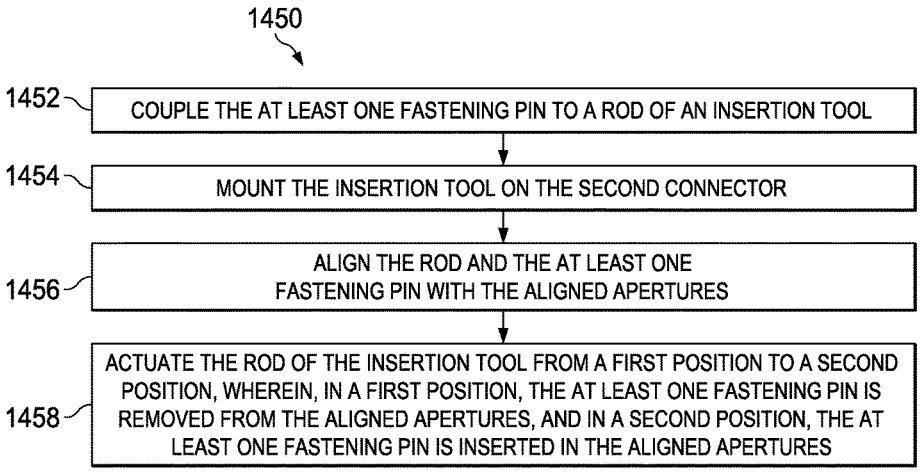

Referring to FIG. 14-1, a flow diagram of process 1400 for assembling a top drive is shown according to one or more aspects of the present disclosure. Process 1400 includes providing a first module and a second module (1402). The first module may include a first connector and may be similar to first module 120 discussed herein. Second module may include a second connector and may be similar to second module 140 discussed herein. Method 1400 may be directed to assembling the first and second modules (and, in some embodiments, a third module) to at least partially assemble a top drive (such as top drive 100 discussed herein).

Process 1400 includes arranging the first module over the second module so that the first connector and the second connector are disposed proximate to the other (1404). In some embodiments, the first connector extends into a cavity of the second connector. In such embodiments, arranging the first module over the second module includes orienting at least one of the first module and the second module so that the first connector extends into a cavity of the second connector. Orienting at least one of the first module and the second module may cause at least one aperture of the first connector to be aligned with at least one aperture of the second connector (1404). In some embodiments, the first and second connectors are otherwise connected without a cavity in the second connector(s). For example, the first connector and second connector are components that are placed adjacent to the other. According to an exemplary embodiment, first module may be lowered onto the second module. In other embodiments, the second module may be brought closer to the first module or the modules may be brought closer to each other. The at least one aperture of the first connector may be similar to bores 612-1, 612-2 discussed herein. The cavity of the second connector and at least one aperture of the second connector may be similar to cavity 228 and bores 614-1, 614-2 discussed herein.

Process 1400 includes coupling the first connector and the second connector to fasten the first module and the second module to each other (1406). The first connector and the second connector may be coupled by any suitable fastening mechanism. In some embodiments, such as when the first connector and the second connector are components that are placed adjacent to each other, a clamping structure may be used to fasten them to each other. In some embodiments, such as when the second connector includes a cavity in which the first connector is received, a fastening pin may be inserted through the aligned apertures of the first and second connectors, to fasten the first and second connector to each other.

Process 1400 includes providing a third module (1408). The third module includes a third connector. The third module may be similar to third module 160 discussed herein.

Process 1400 includes arranging the first module and second module over the third module so that the third connector is disposed proximate to at least one of the first connector and the second connector. In some embodiments, the second connector includes a cavity. The third connector may extend into the cavity of the second connector and an opening of the first connector. In such embodiments, arranging the first module and the second module over the third module includes orienting at least one of the first module, the second module, and the third module so that the first connector extends into a cavity of the second connector. Orienting at least one of the first module, the second module, and the third module may cause at least one aperture of the third connector to be aligned with at least one aperture of the second connector. In some embodiments, the first, second, and third connectors are otherwise connected without a cavity in the second connector(s). For example, the first, second, and third connectors are components that are placed adjacent to the other. According to an exemplary embodiment, the first and second modules, combined in step 1404, may be lowered onto the third module. In other embodiments, the third module may be brought closer to the first and second modules or the modules may be brought closer to each other. The at least one aperture of the third connector may be similar to bore 616 discussed herein. The opening of the first connector may be similar to hollow portion or opening 714 discussed herein.

Process 1400 includes coupling the third connector and at least one of the coupled first connector and the second connector, to fasten the first module, the second module, and the third module to each other (1412). The first connector, the second connector, and/or the third connector may be coupled by any suitable fastening mechanism. In some embodiments, such as when the first, second, and third connectors are components that are placed adjacent to each other, a clamping structure may be used to fasten them to each other. In some embodiments, such as when the second connector includes a cavity in which the first connector is received, a fastening pin may be inserted through the first, second, and/or third connectors.

In some embodiments, process 1400 includes inserting at least one fastening pin through the aligned apertures to fasten the first module, the second module, and the third module to each other. Inserting the at least one fastening pin may be further described with respect to process 1450 (FIG. 14-2). In some embodiments, a fastening pin may be inserted through the aligned apertures of the first module and the second module to fasten the two modules together. A fastening pin may later be inserted through the aligned apertures of the first, second, and third modules to fasten the three modules together. In other embodiments, all modules may be connected and fastened at approximately the same time. In other embodiments, different sub-combinations of modules may be first connected and fastened. The fastening pin may be similar to fastening pins 512-1, 512-2 discussed herein.

Referring to FIG. 14-2, a flow diagram of a process 1450 for inserting at least one fastening pin is shown, according to one or more aspects of the present disclosure. Process 1450 includes coupling at least one fastening pin to a rod of an insertion tool (1452). According to an exemplary embodiment, an operator may manually couple the fastening pin to the rod. The rod may be actuated to an advanced position (i.e., substantially outside of a housing) before the fastening pin is coupled to the rod. The fastening pin may be coupled to the rod with the rod in the advanced position. The fastening pin and rod of the insertion tool may be coupled when a head portion of the fastening pin is received in a neck portion of the rod of the insertion tool and when a head portion of the rod of the insertion tool is received in a neck portion of the fastening pin. The fastening pin may be similar to fastening pins 512-1, 512-2 discussed herein. The rod of the insertion tool may be similar to rods 1110, 1114 discussed herein.

Process 1450 includes mounting the insertion tool on the second connector (1454). According to an exemplary embodiment, the rod of the insertion tool (to which the fastening pin is coupled, from step 1452) is actuated to a retracted position (i.e., substantially inside of a housing) before the insertion tool is mounted on the second connector. When the rod of the insertion tool is actuated to the retracted position, the fastening pin that is coupled to the rod is captured between supporting members of the tool such that the fastening pin does not extend beyond a distal end of the insertion tool. That is, the rod of the insertion tool is retracted to "conceal" the fastening pin with a total volume of the insertion tool. Thus, the insertion tool is not impeded by the fastening pin when the insertion tool is mounted on the second connector (e.g., the fastening pin does not contact the second connector as the insertion tool is mounted). The insertion tool may be slidably mounted to the second connector. In one or more aspects of the present disclosure, at least one lip of the insertion tool is received and slides along a corresponding groove of the second connector when the insertion tool is mounted. At least one lip of the second connector may be received and slide along a corresponding groove of the insertion tool when the insertion tool is mounted. The insertion tool may be similar to tool 900 discussed herein. The second connector may be similar to second connector 226 discussed herein.

Process 1450 includes aligning the rod and the at least one fastening pin with the aligned apertures (1456). In one or more aspects of the present disclosure, an alignment member of the insertion tool is received in an alignment recess of the second connector when the insertion tool and second connector are in axial alignment. When the insertion tool and second connector are in axial alignment, the fastening pin (coupled to a rod of the insertion tool in step 1452) is axially aligned with the aligned apertures. The aligned apertures may be similar to aligned aperture 1124 discussed herein.

Process 1450 includes actuating the rod of the insertion tool from a first position to a second position (1458). According to an exemplary embodiment, in a first position, the at least one fastening pin is removed from the aligned aperture. In a second position, the at least one fastening pin is inserted in the aligned aperture. Actuating the rod of the insertion tool causes the fastening pin to be inserted into the aligned apertures. Thus, two or more modules of the first, second, and third modules are connected and fastened. The first position may be similarly described with respect to the position of rod 1110. The second position may be similarly described with respect to the position of rod 1102.

In some embodiments, process 1400 and/or process 1450 further include disengaging the insertion tool from the second connector. Disengaging the insertion tool may include removing the alignment member from the alignment recess and then slidably removing the insertion tool from the second connector. Process 1400 and/or process 1450 may also further include mounting a plate between a head portion of the at least one fastening pin and the second connector. In one or more aspects of the present disclosure, the plate may be mounted on the second connector during operation of the top drive. The plate may maintain an alignment of the at least one fastening pin when, during operation of the top drive, forces acting on the top drive may cause misalignment. As shown in, e.g., FIG. 8-1, the plate may maintain the openings of the first and second concavity of a fastening pin open towards one direction. This may advantageously enable efficient mounting and removal of the insertion/removal tool because the ends of rods of the insertion/removal tool are sized and shaped for coupling with at least one fastening. The plate may be received in the second concavity of the fastening pin. The plate may be similar to plate 624 discussed herein.

Figure 15:
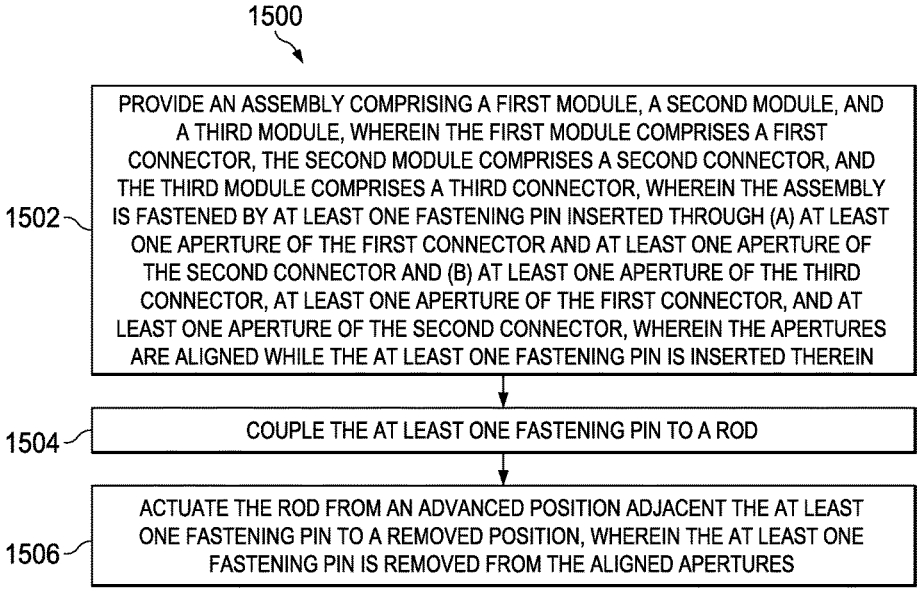
FIG. 15 is a flow diagram of a process for disassembling a top drive, according to one or more aspects of the present disclosure.

Referring to FIG. 15, a flow diagram of a process 1500 for disassembling a top drive is shown, according to one or more aspects of the present disclosure. Process 1500 includes providing an assembly (1502). The assembly may include a first module, a second module, and a third module. The first module may include a first connector, the second module may include a second connector, and the third module may include a third connector. The assembly is fastened by at least one fastening pin inserted through (a) at least one aperture of the first connector and at least one aperture of the second connector and (b) at least one aperture of the third connector and at least one aperture of the second connector. The apertures may be aligned while the at least one fastening pin is inserted therein. The first module, second module, and third module may be similar to first module 120, second module 140, and third module 160, respectively, discussed herein. The first connector, second connector, and third connector may be similar to first connector 224, second connector 226, and third connector 318, respectively, discussed herein. The at least one fastening pin may be similar to fastening pin 512-1, 512-2 discussed herein. The at least one aperture of the first connector may be similar to aperture 612-1, 612-2 discussed herein. The at least one aperture of the second connector may be similar to aperture 614-1, 614-2 discussed herein. The at least one aperture of the third connector may be similar to aperture 616.

In some embodiments, a removal tool may be mounted on the second connector. The removal tool may be slidably mounted on the second connector. In one or more aspects of the present disclosure, at least one lip of the removal tool is received and slides along a corresponding groove of the second connector when the removal tool is mounted. At least one lip of the second connector may similarly be received and slide along a corresponding groove of the removal tool when the removal tool is mounted. The removal tool may be similar to tool 900 discussed herein. The second connector may be similar to second connector 226 discussed herein.

In some embodiments, a rod of the removal tool may be aligned with the at least one fastening pin. In one or more aspects of the present disclosure, an alignment member of the removal tool is received in an alignment recess of the second connector when the removal tool and second connector are in axial alignment. When the insertion tool and second connector are in axial alignment, the fastening pin (inserted into the aligned aperture including an aperture of the second connector) is axially aligned with the rod of the removal tool.

Process 1500 includes coupling at least one fastening pin to a rod (1504). The rod may be a component of a removal tool, such as removal tool 900 discussed herein. In some embodiments, the removal tool is releasably coupled to the second connector. According to an exemplary embodiment, openings of the first and second concavities of the fastening pin may be oriented such that an end portion of the rod engages the fastening pin when the removal tool is aligned. That is, as the removal tool slides onto the second connector, the corresponding head/neck portions of the fastening pin and tool may similarly slide into engagement. The fastening pin and rod of the insertion tool may be coupled when a head portion of the fastening pin is received in a neck portion of the rod of the insertion tool and when a head portion of the rod of the insertion tool is received in a neck portion of the fastening pin. The fastening pin may be similar to fastening pins 512-1, 512-2 discussed herein. The rod of the insertion tool may be similar to rods 1110, 1114 discussed herein.

Process 1500 includes actuating the rod from an advanced position adjacent the at least one fastening pin to a removed position. According to an exemplary embodiment, in an advanced position, the fastening pin is inserted in the aligned apertures. In a removed position, the at least one fastening pin may be removed from the aligned apertures. The advanced position may be similarly described with respect to the position of rod 1110. The removed position may be similarly described with respect to the position of rod 1102.

In some embodiments process 1500 may additionally include disengaging a plate mounted between a head portion of the at least one fastening pin and the second connector and then mounting a removal tool on the second connector. The rod may be a component of the removal tool.

In view of all of the above and the figures, one of ordinary skill in the art will readily recognize that the present disclosure introduces a top drive including a plurality of modules. The top drive includes a first fastening member. The first fastening member includes a proximal end and a distal end. The proximal end extends from a first module. The top drive includes a second fastening member extending from a second module. The first fastening member and the second fastening member are configured to be removably coupled to connect the first module and the second module.

In some embodiments, the top drive includes a third fastening member. The third fastening member includes a proximal end and a distal end. The proximal end extends from a third module. The third fastening member is configured to be removably coupled to at least one of the first fastening member and the second fastening member, to connect the first module, the second module, and the third module. In some embodiments, the second fastening member includes a cavity extending longitudinally therein. The cavity is configured to receive at least a portion of the first fastening member to connect the first module and the second module. In some embodiments, the cavity of the second fastening member is further configured to receive at least a portion of the third fastening member to connect the first module, the second module, and the third module. In some embodiments, the distal end of the first fastening member includes a hollow portion formed therein. The hollow portion is configured to receive at least a portion of the third fastening member to connect the first module, the second module, and the third module. In some embodiments, the distal end of the first fastening member further includes a first bore and a second bore extending laterally therein. The second fastening member further includes a third bore and a fourth bore extending laterally therein. The distal end of the third fastening member further includes a fifth bore extending laterally therein. When the first module, the second module, and the third module are connected, (a) the first bore and the third bore are aligned, and (b) the second bore, the fourth bore, and the fifth bore are aligned. In some embodiments, the top drive further includes a fastening pin removably insertable through at least one of the first fastening member, the second fastening member, and the third fastening member, to secure the first module, the second module, and the third module when connected. In some embodiments, the fastening pin includes a head portion, a neck portion, and a body portion. The head portion of the fastening pin includes a first concavity and the neck portion of the fastening pin includes a second concavity. A radius of the second concavity is greater than a radius of the first concavity. In some embodiments, the top drive includes a plate disposed between the head portion of the fastening pin and the second fastening member. The plate is received in the second concavity. In some embodiments, the top drive includes a tool for inserting the fastening pin through and removing the fastening pin from at least one of the first fastening member, the second fastening member, and the third fastening member. The tool includes a lip for slidably mounting the tool on the second fastening member. The second fastening member further includes a groove for receiving the lip of the tool. In some embodiments, the tool further includes a rod. The rod includes a body portion, a neck portion, and a head portion. The rod is removably coupled to the fastening pin. The first concavity receives the neck portion of the rod, and the second concavity receives the head portion of the rod. In some embodiments, the rod is moveable between a first position and a second position. In a first position, the fastening pin is inserted in at least one of the first fastening member, the second fastening member, and the third fastening member. In a second position, the fastening pin is removed from at least one of the first fastening member, the second fastening member, and the third fastening member. In some embodiments, the tool further includes an alignment member. The second fastening member further includes an alignment recess. The alignment member is received in the alignment recess when the tool is axially aligned with the second fastening member.

The present disclosure also introduces a top drive including a first module. The first module includes a plurality of first connectors. Each of the plurality of first connectors includes a first bore and a second bore extending laterally therein and an opening at a distal end. The top drive includes a second module. The second module includes a plurality of second connectors. Each of the plurality of second connectors includes a cavity extending longitudinally therethrough and a third bore and a fourth bore extending laterally therein. The top drive includes a third module. The third module includes a plurality of third connectors. Each of the plurality of third connectors includes a fifth bore extending laterally therein. The cavity is sized and shaped to receive at least a portion of the first connector and at least a portion of the third connector. The opening is sized and shaped to receive at least a portion of the third connector. The first bore and the third bore are aligned. The second bore, the fourth bore, and the fifth bore are aligned. The top drive includes at least one fastening pin removably inserted through at least one of the first connector, the second connector, and the third connector, to secure the first module, the second module, and the third module to each other.

In some embodiments, the at least one fastening pin includes a head, a neck, and a body. The head includes a first cutaway portion. The neck includes a second cutaway portion. A radius of the second cutaway portion is greater than a radius of the first cutaway portion. In some embodiments, the top drive further includes a plate disposed between the head of the at least one fastening pin and the second connector. The plate is received in the second cutaway portion. In some embodiments, the top drive further includes a tool for inserting the fastening pin through and removing the at least one fastening pin from at least one of the first connector, the second connector, and the third connector. The tool includes a lip for slidably mounting the tool on the second connector. The lip is received in a groove of the second connector. In some embodiments, the tool further includes a rod moveable from a first position inside a housing to a second position outside the housing. The rod includes a body, a neck, and a head. The rod is coupled to the at least one fastening pin during insertion and removal thereof. The first cutaway portion receives the neck of the rod. The second cutaway portion receives the head of the rod. In some embodiments, the tool further includes an alignment member and the second connector further includes an alignment recess. The alignment member is received in the alignment recess when the tool is axially aligned with the second connector.

The present disclosure also introduces a method of assembling a top drive. The method includes providing a first module and a second module. The first module includes a first connector, and the second module includes a second connector. The method includes arranging the first module over the second module so that the first connector and the second connector are disposed proximate to the other. The method includes coupling the first connector and the second connector to fasten the first module and the second module.

In some embodiments, the method includes providing a third module including a third connector. The method includes arranging the first module and the second module on top of the third module so that the third connector is disposed proximate to at least one of the first connector and the second connector. The method includes coupling the third connector and at least one of the coupled first connector and the second connector, to fasten the first module, the second module, and the third module to each other. In some embodiments, arranging the first module over the second module includes orienting the first module so that the first connector extends into a cavity of the second connector and so that at least one aperture of the first connector is aligned with at least one aperture of the second connector. In some embodiments, arranging the first module and the second module over the third module includes orienting the third module so that the third connector extends into the cavity of the second connector and an opening of the first connector, and so that at least one aperture of the third connector is aligned with the at least one aperture of the second connector. In some embodiments, the method includes inserting at least one fastening pin through the aligned apertures of the first connector, the second connector, and the third connector, to fasten the first module, the second module, and the third module to each other. In some embodiments, inserting the at least one fastening pin includes coupling the at least one fastening pin to a rod of an insertion tool; mounting the insertion tool on the second connector; aligning the rod and the at least one fastening pin with the aligned apertures; and actuating the rod of the insertion tool from a retracted position to an advanced position, wherein, in the retracted position, the at least one fastening pin is removed from the aligned apertures, and in the advanced position, the at least one fastening pin is inserted through the aligned apertures. In some embodiments, the method includes disengaging the insertion tool from the second connector and mounting a plate between a head portion of the at least one fastening pin and the second connector.

The present disclosure also introduces a method of disassembling a top drive. The method includes providing an assembly including a first module, a second module, and a third module. The first module comprises a first connector, the second module comprises a second connector, and the third module comprises a third connector. The assembly is fastened by at least one fastening pin inserted through (a) at least one aperture of the first connector and at least one aperture of the second connector and (b) at least one aperture of the third connector, at least one aperture of the first connector, and at least one aperture of the second connector. The apertures are aligned while the at least one fastening pin is inserted therein. The method includes coupling the at least one fastening pin to a rod. The method includes actuating the rod from the advanced position adjacent the at least one fastening pin to a removed position. In a removed position, the at least one fastening pin is removed from the aligned apertures.

In some embodiments, the method includes disengaging a plate mounted between a head portion of the at least one fastening pin and the second connector and then mounting the removal tool on the second connector.

The present disclosure also introduces a tool for assembling or disassembling a top drive. The tool includes a fastening portion including a proximal part and a distal part. The distal part includes an attachment mechanism configured to releasably couple the tool to a portion of a top drive. The tool includes a first housing coupled to the proximal part of the fastening portion and including a recess disposed therein. The tool includes a first rod disposed at least partially within the recess of the first housing and along a longitudinal axis of the first housing.

In some embodiments, the attachment mechanism includes a first lip configured to be slidably received in a first groove of the top drive portion. In some embodiments, the attachment mechanism further includes a second lip configured to be slidably received in a second groove of the top drive portion. The top drive portion is a top drive module. In some embodiments, the tool includes at least one support member disposed between the fastening portion and the first housing. The at least one support member is coupled to the fastening portion and the first housing. In some embodiments, the first rod is configured to be removably coupled to a fastening pin. The fastening pin is removably insertable into the top drive module so as to connect at least a first top drive module and second top drive module to each other when inserted into a connection portion of each of the first and second top drive modules. In some embodiments, the first rod includes a body portion, a neck portion, and a head portion. A radius of the neck portion being smaller than a radius of the head portion. In some embodiments, the first rod is moveable between a retracted position and an advanced position. In the retracted position, the first rod is substantially inside of the first housing. In the advanced position, the first rod is substantially outside the first housing. In some embodiments, the first housing is fluidly coupled to a hydraulic line. The first rod is hydraulically actuated between the retracted position and the advanced position. In some embodiments, the tool includes an alignment member configured to be received in an alignment recess of the top drive module when the tool is axially aligned with the top drive module. In some embodiments, the tool includes a second housing coupled to the proximal part of the fastening portion and including a recess disposed therein. The tool includes a second rod disposed at least partially within the recess of the second housing and along a longitudinal axis of the second housing.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A top drive including a plurality of modules, comprising:

a first fastening member comprising a proximal end and a distal end, the proximal end extending from a first module;

a second fastening member extending from a second module;

wherein the first fastening member and the second fastening member are configured to be removably coupled to connect the first module and the second module; and a third fastening member comprising a proximal end and a distal end, the proximal end extending from a third module, wherein the third fastening member is configured to be removably coupled to at least one of the first fastening member and the second fastening member, to connect the first module, the second module, and the third module;

wherein the distal end of the first fastening member comprises a hollow portion formed therein, the hollow portion being configured to receive at least a portion of the third fastening member to connect the first module, the second module, and the third module.

2. The top drive of claim 1, wherein the second fastening member comprises a cavity extending longitudinally therein, the cavity being configured to receive at least a portion of the first fastening member to connect the first module and the second module.

3. The top drive of claim 2, wherein the cavity of the second fastening member is further configured to receive at least a portion of the third fastening member to connect the first module, the second module, and the third module.

4. The top drive of claim 1, wherein:

the distal end of the first fastening member further comprises a first bore and a second bore extending laterally therein;

the second fastening member further comprises a third bore and a fourth bore extending laterally therein;

the distal end of the third fastening member further comprises a fifth bore extending laterally therein; and wherein, when the first module, the second module, and the third module are connected, (a) the first bore and the third bore are aligned, and (b) the second bore, the fourth bore, and the fifth bore are aligned.

5. The top drive of claim 1, further comprising a fastening pin removably insertable through at least one of the first fastening member, the second fastening member, and the third fastening member, to secure the first module, the second module, and the third module when connected.

6. The top drive of claim 5, wherein the fastening pin comprises a head portion, a neck portion, and a body portion, the head portion of the fastening pin comprising a first concavity and the neck portion of the fastening pin comprising a second concavity, a radius of the second concavity being greater than a radius of the first concavity.

7. The top drive of claim 6, further comprising a plate disposed between the head portion of the fastening pin and the second fastening member, the plate being received in the second concavity.

8. The top drive of claim 6, further comprising:

a tool for inserting the fastening pin through and removing the fastening pin from at least one of the first fastening member, the second fastening member, and the third fastening member, the tool comprising a lip for slidably mounting the tool on the second fastening member; and wherein the second fastening member further comprises a groove for receiving the lip of the tool.

9. The top drive of claim 8, wherein the tool further comprises:

a rod comprising a body portion, a neck portion, and a head portion, wherein the rod is removably coupled to the fastening pin, the first concavity receiving the neck portion of the rod and the second concavity receiving the head portion of the rod.

10. The top drive of claim 9, wherein the rod is moveable between a first position and a second position, wherein, in a first position, the fastening pin is inserted in at least one of the first fastening member, the second fastening member, and the third fastening member, and, in a second position, the fastening pin is removed from at least one of the first fastening member, the second fastening member, and the third fastening member.

11. The top drive of claim 8, wherein the tool further comprises an alignment member and the second fastening member further comprises an alignment recess, the alignment member being received in the alignment recess when the tool is axially aligned with the second fastening member.

12. A top drive, comprising:

a first module comprising a plurality of first connectors, each of the plurality of first connectors comprising a first bore and a second bore extending laterally therein and an opening at a distal end;

a second module comprising a plurality of second connectors, each of the plurality of second connectors comprising a cavity extending longitudinally therethrough and a third bore and a fourth bore extending laterally therein;

a third module comprising a plurality of third connectors, each of the plurality of third connectors comprising a fifth bore extending laterally therein;

the cavity being sized and shaped to receive at least a portion of the first connector and at least a portion of the third connector;

the opening being sized and shaped to receive at least a portion of the third connector;

the first bore and the third bore being aligned, and the second bore, the fourth bore, and the fifth bore being aligned; and at least one fastening pin removably inserted through at least one of the first connector, the second connector, and the third connector, to secure the first module, the second module, and the third module to each other.

13. The top drive of claim 12, wherein the at least one fastening pin comprises a head, a neck, and a body, the head comprising a first cutaway portion and the neck comprising a second cutaway portion, a radius of the second cutaway portion being greater than a radius of the first cutaway portion.

14. The top drive of claim 13, further comprising a plate disposed between the head of the at least one fastening pin and the second connector, the plate being received in the second cutaway portion.

15. The top drive of claim 13, further comprising:

a tool for inserting the at least one fastening pin through and removing the at least one fastening pin from at least one of the first connector, the second connector, and the third connector, the tool comprising a lip for slidably mounting the tool on the second connector, the lip being received in a groove of the second connector.

16. The top drive of claim 15, wherein the tool further comprises:

a rod moveable from a first position inside a housing to a second position outside the housing, the rod comprising a body, a neck, and a head, wherein the rod is coupled to the at least one fastening pin during insertion and removal thereof, the first cutaway portion receiving the neck of the rod and the second cutaway portion receiving the head of the rod.

17. The top drive of claim 15, wherein the tool further comprises an alignment member and the second connector further comprises an alignment recess, the alignment member being received in the alignment recess when the tool is axially aligned with the second connector.

18. A method of assembling a top drive, comprising:

providing a first module and a second module, wherein the first module comprises a first connector and the second module comprises a second connector;

arranging the first module over the second module so that the first connector and the second connector are disposed proximate to the other;

coupling the first connector and the second connector to fasten the first module and the second module;

providing a third module comprising a third connector;

arranging the first module and the second module over the third module so that the third connector is disposed proximate to at least one of the first connector and the second connector; and coupling the third connector and at least one of the coupled first connector and the second connector, to fasten the first module, the second module, and the third module to each other.

19. The method of claim 18, wherein arranging the first module over the second module comprises:

orienting the first module so that the first connector extends into a cavity of the second connector and so that at least one aperture of the first connector is aligned with at least one aperture of the second connector.

20. The method of claim 19, wherein arranging the first module and the second module over the third module comprises:

orienting the third module so that the third connector extends into the cavity of the second connector and an opening of the first connector, and so that at least one aperture of the third connector is aligned with the at least one aperture of the second connector.

21. The method of claim 20, further comprising:

inserting at least one fastening pin through the aligned apertures of the first connector, the second connector, and the third connector, to fasten the first module, the second module, and the third module to each other.

22. The method of claim 21, wherein inserting the at least one fastening pin comprises:

coupling the at least one fastening pin to a rod of an insertion tool;

mounting the insertion tool on the second connector;

aligning the rod and the at least one fastening pin with the aligned apertures; and actuating the rod of the insertion tool from a retracted position to an advanced position, wherein, in the retracted position, the at least one fastening pin is removed from the aligned apertures, and in the advanced position, the at least one fastening pin is inserted through the aligned apertures.

23. The method of claim 22, further comprising:

disengaging the insertion tool from the second connector;

mounting a plate between a head portion of the at least one fastening pin and the second connector.

24. A method of disassembling a top drive, comprising:

providing an assembly comprising a first module, a second module, and a third module, wherein the first module comprises a first connector, the second module comprises a second connector, and the third module comprises a third connector, Wherein the assembly is fastened by at least one fastening pin inserted through (a) at least one aperture of the first connector and at least one aperture of the second connector and (b) at least one aperture of the third connector, at least one aperture of the first connector, and at least one aperture of the second connector, wherein the apertures are aligned while the at least one fastening pin is inserted therein;

coupling the at least one fastening pin to a rod; and actuating the rod from an advanced position adjacent the at least one fastening pin to a removed position, wherein the at least one fastening pin is removed from the aligned apertures.

25. The method of claim 24, further comprising:

disengaging a plate mounted between a head portion of the at least one fastening pin and the second connector and then mounting a removal tool on the second connector.

26. A top drive including a plurality of modules, comprising:

a bearing housing module comprising a first fastening member, the first fastening member comprising a proximal end and a distal end, the proximal end extending from the bearing, housing module; and a gear box module comprising a second fastening member extending from the gear box module, wherein the first fastening member and the second fastening member are configured to be removably coupled to connect the bearing housing module and the gear box module;

a pipe handler module comprising a third fastening member, the third fastening member comprising a proximal end and a distal end, the proximal end extending from the pipe handler module, wherein the third fastening member is configured to be removably coupled to at least one of the first fastening member and the second fastening member, to connect the bearing housing module, the gear box module, and the pipe handler module, wherein the distal end of the first fastening member comprises a hollow portion formed therein, the hollow portion being configured to receive at least a portion of the third fastening member to connect the bearing housing module, the gear box module, and the pipe handler module.

* * * * *